US007059550B2

(12) United States Patent
Graham et al.

(10) Patent No.: US 7,059,550 B2
(45) **Date of Patent: *Jun. 13, 2006**

(54) SYSTEM AND METHOD FOR PULVERIZING AND EXTRACTING MOISTURE

(75) Inventors: William Graham, Somerset West (ZA); Levi New, Kalamazoo, MI (US); Wayne Arthur Case, Portland, OR (US)

(73) Assignee: Power Technologies Investment Ltd., Singapore (SG)

( * ) Notice: Subject to any disclaimer, the term of this patent is extended or adjusted under 35 U.S.C. 154(b) by 208 days.

This patent is subject to a terminal disclaimer.

(21) Appl. No.: 10/706,240

(22) Filed: Nov. 12, 2003

(65) Prior Publication Data

US 2004/0200910 A1 Oct. 14, 2004

Related U.S. Application Data

(63) Continuation-in-part of application No. 09/792,061, filed on Feb. 26, 2001, now Pat. No. 6,722,594.

(51) Int. Cl.
*B02C 19/06* (2006.01)

(52) U.S. Cl. ..... 241/1; 241/5; 241/39; 241/301

(58) Field of Classification Search ..... 241/1, 241/301, 5, 39; 366/163.2; 137/888
See application file for complete search history.

(56) References Cited

U.S. PATENT DOCUMENTS

| | | | | |
|---|---|---|---|---|
| 2,315,083 | A * | 3/1943 | Chesler | 241/5 |
| 2,832,545 | A * | 4/1958 | Segraves | 241/1 |
| 3,255,793 | A | 6/1966 | Clute | |
| 4,390,131 | A | 6/1983 | Pickrel | |
| 4,418,871 | A | 12/1983 | Powell | |
| 4,439,042 | A | 3/1984 | Bertoglio | |
| 6,024,307 | A | 2/2000 | Sand et al. | |
| 6,289,143 | B1 | 9/2001 | Berthold et al. | |
| 6,491,242 | B1 | 12/2002 | Dingee, IV et al. | |
| 6,588,686 | B1 | 7/2003 | Dingee, IV et al. | |
| 6,722,594 | B1 | 4/2004 | Graham | 241/39 |
| 2001/0042802 | A1 | 11/2001 | Youds | |
| 2004/0141410 | A1 * | 7/2004 | Fenton et al. | 366/163.2 |
| 2004/0200910 | A1 | 10/2004 | Graham et al. | |

FOREIGN PATENT DOCUMENTS

| | | |
|---|---|---|
| DE | 197 47 628 A 1 | 5/1999 |
| EP | 0 079 300 A | 10/1985 |

(Continued)

OTHER PUBLICATIONS

PCT Invitation to Pay Additional Fees and Annex to Form PCT/ISA/206, Communication Relating to the Results of the Partial International Search for PCT/ZA2005/000006, 5 pgs.

(Continued)

*Primary Examiner*—Mark Rosenbaum
(74) *Attorney, Agent, or Firm*—John R. Thompson; Stoel Rives LLP

(57) ABSTRACT

A venturi receives incoming material through an inlet tube and subjects the material to pulverization. The material, as it undergoes pulverization, is further subject to moisture extraction and drying. An airflow generator, coupled to the venturi, generates a high speed airflow to pull the material through the venturi and into an inlet aperture in the airflow generator. The airflow generator directs the received pulverized material to an outlet where the material may be subsequently separated from the air.

110 Claims, 15 Drawing Sheets

FOREIGN PATENT DOCUMENTS

| | | | |
|---|---|---|---|
| FR | 2 311 588 | A | 12/1976 |
| FR | 2 661 450 | A1 | 4/1990 |
| GB | 313 582 | A | 12/1929 |
| GB | 591 921 | A | 9/1947 |
| GB | 911 454 | | 11/1962 |
| GB | 2 358 629 | | 1/2001 |
| GB | 2 354 232 | | 3/2001 |
| GB | 2 357 499 | | 6/2001 |
| GB | 2357712 | A | 7/2001 |
| GB | 2 357 712 | B | 10/2002 |
| JP | 01125554 | | 5/1989 |
| JP | 11 160290 | A | 6/1999 |
| WO | 92/12795 | A | 8/1992 |
| WO | WO 98/35756 | | 8/1998 |
| WO | 99/53130 | | 10/1999 |
| WO | WO 00/13799 | A | 3/2000 |
| WO | WO 01/03840 | A1 | 1/2001 |
| WO | WO 01/12332 | | 2/2001 |
| WO | WO 93/12884 | A1 | 7/2001 |
| WO | 02/08630 | | 1/2002 |
| WO | WO 03/006166 | A1 | 1/2003 |

OTHER PUBLICATIONS

U.K. Patent Office Search Report for GB0406494.5, dated Nov. 10, 2004, 1 pg.

Annex to Form PCT/ISA/206, Communicaion Relating to the Results of the Partial International Search for PCT/ZA2004/000126, 2 pgs.

U.S. Appl. No. 10/816,124, filed Apr. 1, 2004, Graham et al.

U.S. Appl. No. 10/750,901, filed Jan. 5, 2004, Graham.

* cited by examiner

SYSTEM AND METHOD FOR PULVERIZING AND EXTRACTING MOISTURE

RELATED APPLICATIONS

This utility application claims priority to U.S. patent application Ser. No. 09/792,061 filed Feb. 26, 2001 now U.S. Pat. No. 6,722,594 and entitled Pulveriser and Method of Pulverising and is hereby incorporated by reference.

TECHNICAL FIELD

The present invention relates to techniques for processing materials to pulverize and extract moisture.

BACKGROUND OF THE INVENTION

Numerous industries require the labor intensive task of reducing materials to smaller particles and even to a fine powder. For example, the utility industry requires coal to be reduced from nuggets to powder before being burned in power generation furnaces. Limestone, chalk and many other minerals must also, for most uses, be reduced to powder form. Breaking up solids and grinding it into powder is a mechanically demanding process. Ball mills, hammer mills, and other mechanical structures impact on, and crush, the pieces of material. These systems, although functional, are inefficient and relatively slow in processing.

Numerous industries further require moisture extraction from a wide range of materials. Food processing, sewage waste treatment, crop harvesting, mining, and many other industries require moisture extraction. In some industries materials are discarded because moisture extraction cannot be performed efficiently. These same materials, if they could be efficiently dried, would otherwise provide a commercial benefit. In other industries, such as waste treatment and processing, water extraction is an ongoing concern and tremendous demand exists for improved methods. Although several techniques exist for dehydrating materials, there is an increasing need for improved moisture extraction efficiency.

Thus, it would be an advancement in the art to provide more efficient processes for pulverizing materials and extracting moisture from materials. Such techniques are disclosed and claimed herein.

BRIEF DESCRIPTION OF THE DRAWINGS

A more particular description of the invention briefly described above will be rendered by reference to the appended drawings. Understanding that these drawings only provide information concerning typical embodiments of the invention and are not therefore to be considered limiting of its scope, the invention will be described and explained with additional specificity and detail through the use of the accompanying drawings, in which.

DETAILED DESCRIPTION OF PREFERRED EMBODIMENTS

Figure 1:
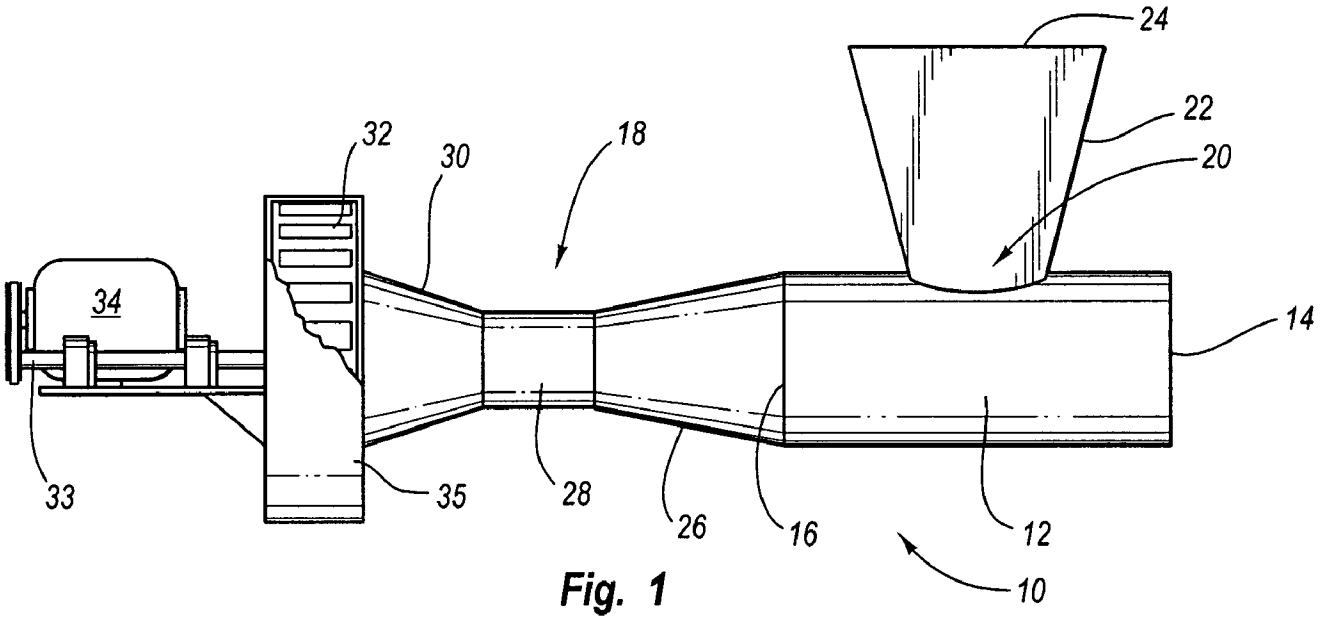
FIG. 1 is a side view illustrating one embodiment of a pulverizing system of the present invention.

Reference is now made to the figures in which like reference numerals refer to like elements. For clarity, the first digit or digits of a reference numeral indicates the figure number in which the corresponding element is first used.

Throughout the specification, reference to "one embodiment" or "an embodiment" means that a particular described feature, structure, or characteristic is included in at least one embodiment of the present invention. Thus, appearances of the phrases "in one embodiment" or "in an embodiment" in various places throughout this specification are not necessarily all referring to the same embodiment.

Furthermore, the described features, structures, or characteristics may be combined in any suitable manner in one or more embodiments. Those skilled in the art will recognize that the invention can be practiced without one or more of the specific details, or with other methods, components, materials, etc. In other instances, well-known structures, materials, or operations are not shown or not described in detail to avoid obscuring aspects of the invention.

Figure 2:
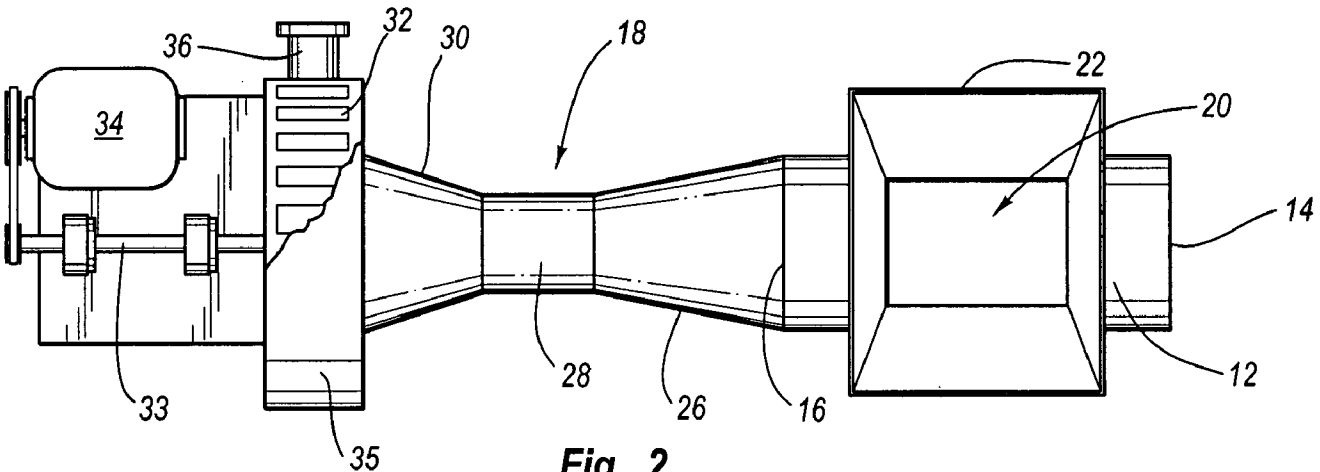
FIG. 2 is a plan view illustrating the pulverizing system of FIG. 1.

Referring to FIGS. 1 and 2, a system 10 for pulverizing and extracting moisture is shown that includes an inlet tube 12. The inlet tube 12 includes a first end 14, communicating with free space and an opposing, second end 16 that couples to a venturi 18. Although reference is made herein to tubes and pipes, one of skill in the art will appreciate that all such elements may have circular, rectangular, hexagonal, and other cross-sectional shapes. Generally, circular cross-sections are desirable to facilitate fabrication and operation, but the invention is not limited to such a specific implementation.

The inlet tube 12 provides some distance to the venturi 18 in which material can accelerate to the required velocity. A filter (not shown) may be placed to cover the first end 14 to prevent introduction of foreign particles into the system 10. The inlet tube 12 further includes an elongated opening 20 on an upper part thereof to allow communication with the open lower end of a hopper 22. The hopper 22 is open at its upper end 24 to receive materials. In an alternative embodiment, the system 10 does not include a hopper 10 and material is simply inserted into the elongated opening 20 through various known conventional methods.

The venturi 18 includes a converging portion 26 coupled to the inlet tube 12. The converging portion 26 progressively reduces in diameter from that of the inlet tube 12 to a diameter smaller than the inlet tube 12. The venturi 18 further includes a throat 28 that maintains a consistent diameter and is smaller than the diameter of the inlet tube 12. The venturi 18 further includes a diverging portion 30 that couples to the throat 28 and progressively increases in diameter in the direction of airflow. The diverging portion 30 may be coupled to the throat 28 by casting, screw threads, or by other known methods. As illustrated, the converging portion 26 may be longer in longitudinal length than the diverging portion 30.

The venturi 18 is in communication with an airflow generator 32 that creates an airflow flowing from the first end 14, through the inlet tube 12, through the venturi 18, and to the airflow generator 32. The velocity of the generated airflow may range from 350 mph to supersonic. The airflow velocity will be greater in the venturi 18 than in the inlet tube 12. The airflow generator 32 may be embodied as a fan, impeller, turbine, a hybrid of a turbine and fan, a pneumatic suction system, or other suitable device for generating a high speed airflow.

The airflow generator 32 is driven by a drive motor 34 that is generically represented and one of skill in the art will appreciate that any number of motors may be used, all of which are within the scope of the invention. The drive motor 34 couples to an axel 33 using known methods. The axel 33 engages the airflow generator 32 to power rotation. The horse power of a drive motor 34 will vary significantly, such as from 15 hp to 1000 hp, and depends on material to be treated, material flow rate, and airflow generator dimensions. Thus, this range is for illustrative purposes only as the system 10 can be scaled up or down. An upper scale system 10 may be used at a municipal waste processing facility whereas a smaller scale system 10 may be used to process sewage waste on board an ocean vessel.

The airflow generator 32 includes a plurality of radially extending blades that rotate to generate a high speed airflow. The airflow generator 32 is disposed within a housing 35 that includes a housing outlet 36 that provides an exit to incoming air. The housing 35 couples with the venturi 18 and has a housing input aperture (not shown) that allows communication between the venturi 18 and the interior of the housing 35. The blades define radially extending flow passages through which air passes to a housing outlet 36 on its periphery to allow pulverized material to exit. One embodiment of an airflow generator 32 suitable for use with the present invention is discussed in further detail below in reference to FIGS. 11 to 18.

Figure 3:
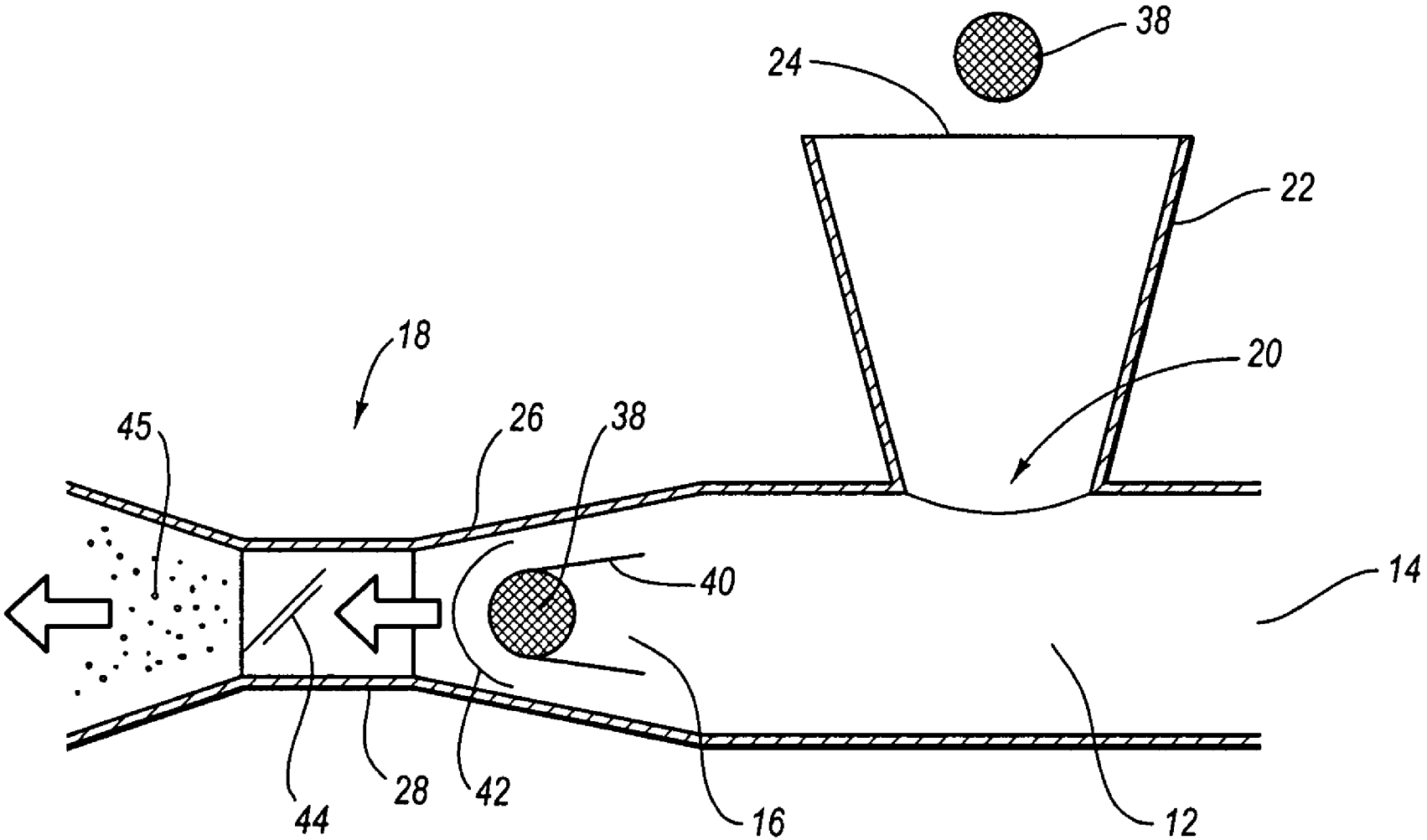
FIG. 3 is a cross-sectional side view illustrating a venturi of a pulverizing system as the venturi receives material.

Referring to FIG. 3, a diagram is shown illustrating operation of the venturi 18 during a pulverization event. In operation, material 38 is introduced into the inlet tube 12 through any number of conveyance methods. The material 38 may be a solid or a semi-solid. The airflow generator 32 generates an air stream, ranging from 350 mph to supersonic, that flows through the inlet tube 12 and through the venturi 18. In the venturi 18, the airflow velocity substantially accelerates. The material 38 is propelled by the high speed airflow to the venturi 18. The material 38 is smaller in diameter than the interior diameter of the inlet tube 12 and a gap exists between the inner surface of the inlet tube 12 and the material 38.

As the material 38 enters the converging portion 26, the gap becomes narrower and eventually the material 38 causes a substantial reduction in the area of the converging portion 26 through which air can flow. A recompression shock wave 40 trails rearwardly from the material and a bow shock wave 42 builds up ahead of the material 38. Where the converging portion 26 merges with the throat 28 there is a standing shock wave 44. The action of these shock waves 40, 42, 44 impacts the material 38 and results in pulverization and moisture extraction from the material. The pulverized material 45 continues through the venturi 18 and exits into the airflow generator 32.

The material size reduction depends on the material to be pulverized and the dimensions of the system 10. By increasing the velocity of the airflow, pulverization and particle size reduction increases with certain materials. Thus, the system 10 allows the user to vary desired particle dimensions by varying the velocity of the airflow.

The system 10 has particular application in pulverizing solid materials into a fine dust. The system 10 has further application in extracting moisture from semi-solid materials such as municipal waste, paper sludge, animal by-product waste, fruit pulp, and so forth. The system 10 may be used in a wide range of commercial and industrial applications.

Figure 4:
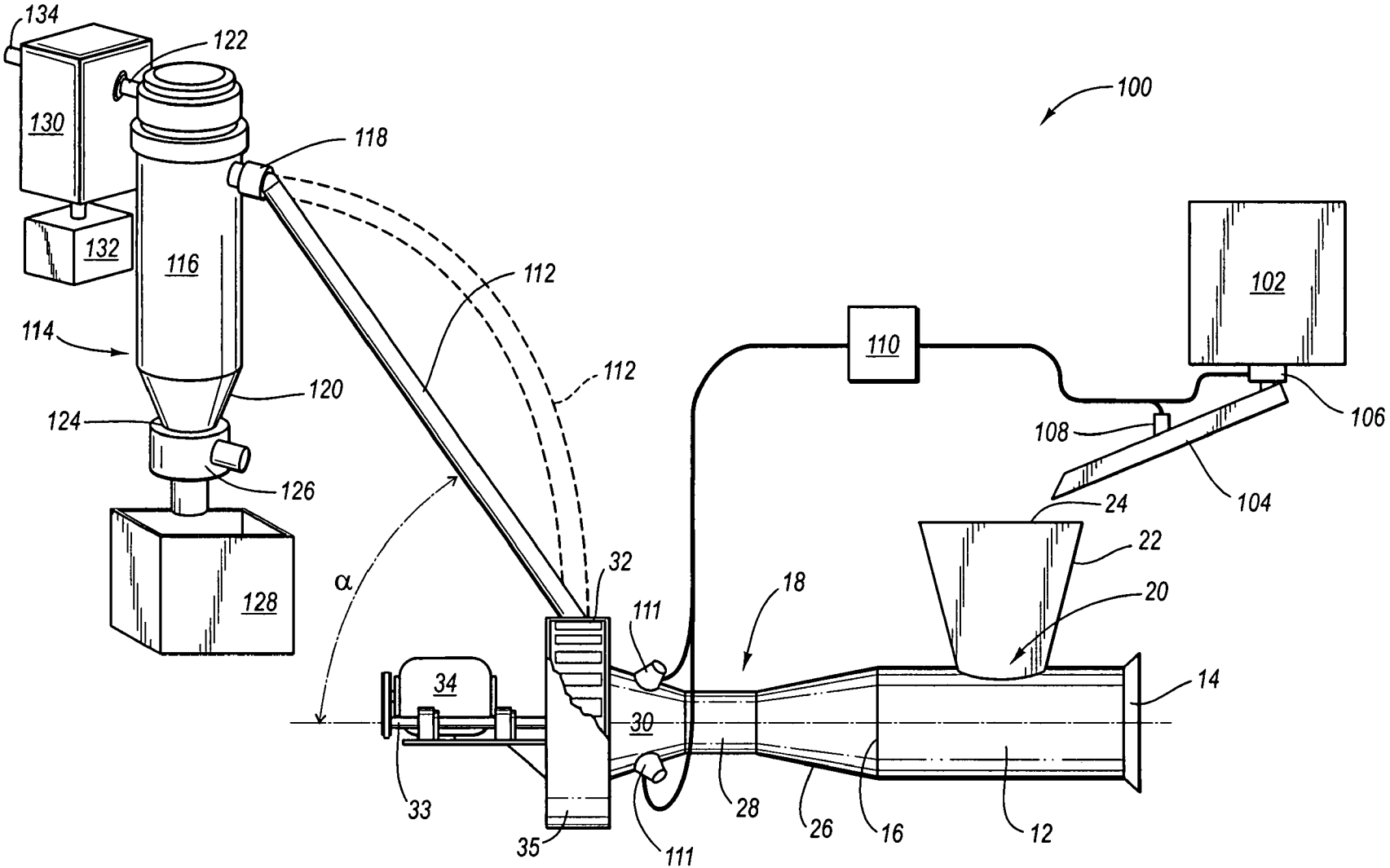
FIG. 4 is a side view illustrating an alternative embodiment of a pulverizing system of the present invention.
Figure 5:
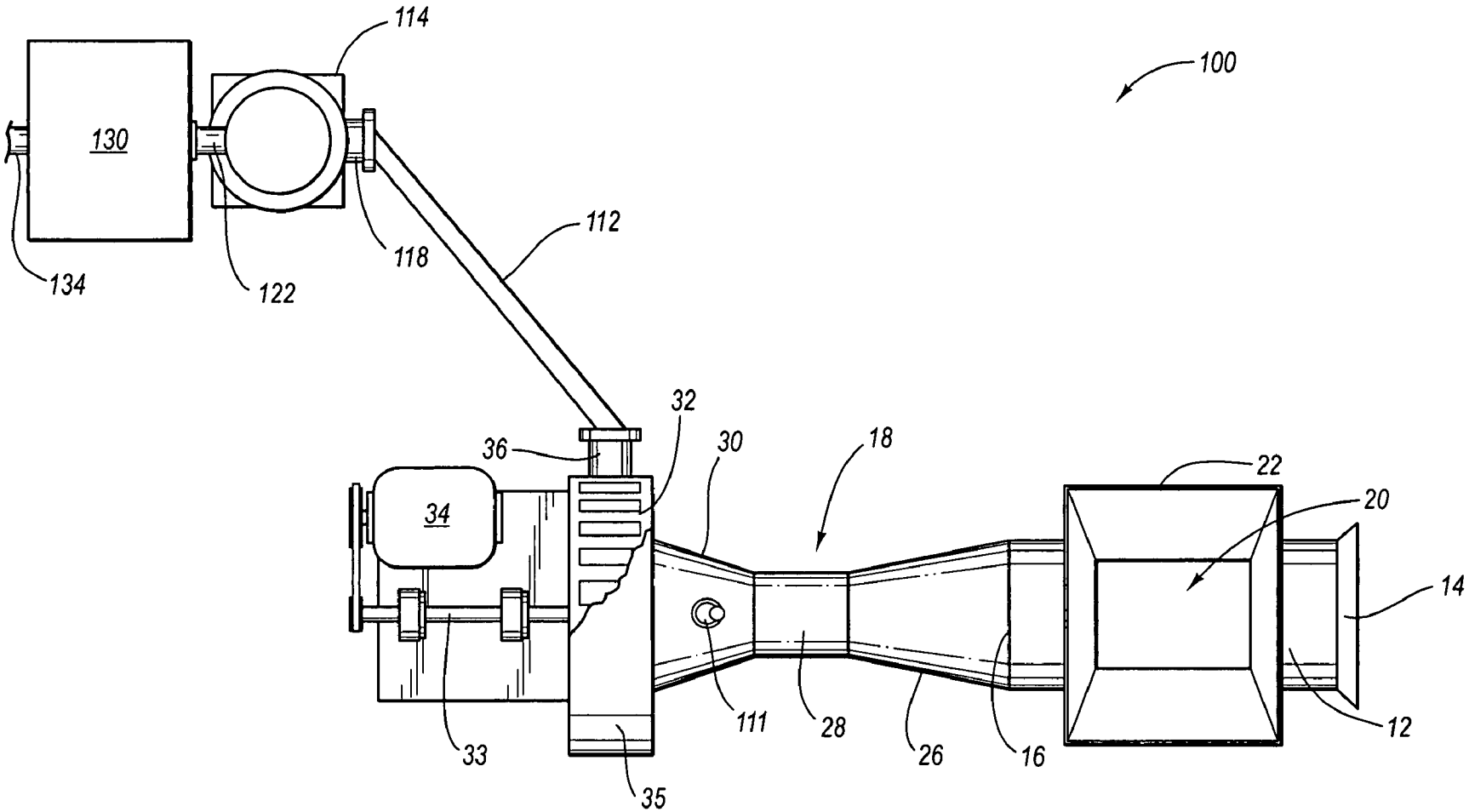
FIG. 5 is a plan view illustrating a plan view of the pulverizing system of FIG. 4.

Referring to FIGS. 4 and 5, an alternative embodiment of a system 100 of the present invention is shown for extracting moisture from materials. The system 100 may include a blender 102 for blending materials in a preprocessing stage. Raw material may include polymers that tend to lump the material into granules. The granules may be oversized and, due to the polymers, resist breaking down into a desired powder form.

The presence of polymers is typical with municipal waste as polymers are introduced during sewage treatment to bring the waste particles together. Waste is processed on a belt press resulting in a material that is mostly semi-solid. In some processes the material may be approximately 15 to 20 percent solid and the remainder moisture.

In the preprocessing stage, a drying enhancing agent is mixed with the raw material to break down the polymers and the granulization of the material. Non-polymerized products may be processed without the blending. Raw material is introduced into the blender 102 that blends the material with a certain amount of a drying enhancing agent. The drying enhancing agent may be selected from a wide range of enhancers such as attapulgite, coal, lime, and the like. The drying enhancing agent may also be a pulverized and dried form of the raw material. The blender 102 mixes the material with the drying enhancing agent to produce an appropriate moisture content and granular size.

The raw material is transferred from the blender 102 to the hopper 22 in any one of a number of methods including use of a conveyance device 104 such as a belt conveyor, screw conveyor, extruder, or other motorized devices. In the illustrated embodiment, the conveyance device 104 is an inclined track that relies on gravity to deliver raw material to the hopper 22. The conveyance device 104 is positioned below a flow control valve 106 located on the lower portion of the blender 102.

In an alternative embodiment, the hopper 22 may be eliminated and material is delivered directly to the elongated opening 20 of the inlet tube 12. The hopper 22 is only one device that may be used to facilitate delivery of material to the inlet tube 12. Any number of other types of conveyance devices may be used as well as manual delivery.

One or more sensors 108 may monitor the flow rate of material passing from the blender 102 to the inlet tube 12. A sensor 108 is in communication with a central processor 110 to regulate the flow rate. The sensor 108 may be disposed proximate to the conveyance device 104, proximate to the hopper 22, within the hopper 22, or even between the hopper 22 and the elongated opening 20 to monitor the material flow rate. The central processor 110 is in communication with the flow control valve 106 to increase or decrease the flow rate as needed. Alternative methods for monitoring and controlling the flow rate may also be used including visual inspection and manual adjustment of the flow control valve 106.

The hopper 22 receives the material and delivers the material to the elongated opening 20 of the inlet tube 12. The elongated opening 20 may be equal to or less than 4" wide and 5" long to maintain an acceptable feed flow for certain applications. The length of inlet tube 12 from the elongated opening 20 to the venturi 18 may range from 24" (610 mm) to 72" (1830 mm) or more and depends on material to be processed and the flow rate. One of skill in the art will appreciate that the dimension are for illustrated purposes only as the system 10 is scalable.

The airflow pulls the material from the inlet tube 12 through the venturi 18. In the illustrated embodiment, the first end 14 is configured as a flange to converge from a diameter greater than the inlet tube 12 to the diameter of the inlet tube. The flange configured first end 14 increases airflow volume into the inlet tube 12.

Certain embodiments have the throat diameter of the venturi 18 ranging from approximately 1.5" (38 mm) to approximately 6" (152 mm). The throat diameter is scalable based on material flow volume and may exceed the previously stated range. The throat diameter of the venturi 18 and the inlet tube 12 are directly proportional. In one embodiment, the throat diameter is 2.75" and operates with an inlet tube diameter of 5.5" (139.33 mm). In an alternative embodiment, the throat diameter may be 2.25" (57 mm) and operates properly with an inlet tube diameter of 4.50" (114 mm). Thus, a 2 to 1 ratio ensures that raw feed material is captured in the incoming airflow.

In the illustrated embodiment, the diverging section 30 couples to the housing 35 and communicates directly with the housing 35. The final diameter of the diverging section 30 is not necessarily the same as the inlet tube 12. In an alternative embodiment, the diverging section 30 may couple to an intermediary component, such as a cylinder, tube, or pipe, prior to coupling with the housing 35.

One or more flow valves 111 may be disposed on the diverging portion 30 and provide additional air volume into the interior of the housing 35 and the airflow generator 32. The additional air volume increases the airflow generator 32 performance. In one embodiment, two flow valves 111 are disposed on the diverging portion 30. The system 100 may be operated with the flow valves 111 partially or completely opened. If material begins to obstruct the venturi 18, the flow valves 111 may be closed. This results in more airflow through the venturi 18 to provide additional force and drive material through the venturi 18 and the airflow generator 32. The flow valves 111 are adjustable and are shown in electrical communication with the central processor 110 for control. Although manual operation of the flow valves 111 is within the scope of the invention, computer automation greatly facilitates the process.

The venturi 18 provides a point of impact between higher velocity shock waves and lower velocity shock waves. The shockwaves provide a pulverization and moisture extraction event within the venturi 18. In operation, there are no visible signs of moisture on the interior of the venturi 18 or in the housing outlet 36. The amount of moisture removed is substantial although a residual amount may remain. The pulverization event further reduces the size of materials. It has been experienced that certain materials having a diameter of 2" (50 mm) entering the venturi 18 are reduced to a fine powder with a diameter of 20 um in one pulverization event. Size reduction depends on the material being processed and the number of pulverization events. Separating water from the material has numerous applications such as material dehydration and greatly reducing the number of pathogens. The possible applications for the present invention reach through a number of industries, the ramifications of which are only beginning to be realized.

The present invention has particular application in processing municipal waste. The preprocessing step of blending a drying enhancing agent provides a waste material that is readily processed by the system 100. It is believed that the pulverizing and moisture extraction process greatly reduces the amount of illness causing pathogens in the waste material by rupturing their cell wall. A second source of pathogen reduction is moisture extraction which reduces the pathogens. Analytical data from treating municipal waste shows that the present invention eliminates the majority of total *colifrom, faecal coliform, escherichia coli*, and other pathogens.

The present invention has specific application in extracting moisture from fruit and vegetable products. In one application, the system 100 may be used to dehydrate fruit and vegetable products such as apples, oranges, carrots, nectarines, peaches, melons, tomatoes, and so forth. Extracted moisture, which is relatively sanitary, may be condensed and recaptured to provide a pure juice product.

In another application, the invention may be used to pulverize and extract water from certain agricultural products such as banana stalk, palm trees, sugar canes, rhubarb, and so forth. In pulverizing banana stalk fibers, the fibers are separated and moisture is extracted. Commercial applications exist in taking agricultural products from their natural state to a dehydrated state. Certain man-made products such as steel, rubber or plastics do not contain air as part of their natural composition and therefore cannot be pulverized.

The material, moisture, and air stream proceed through the airflow generator 32 and exit through the housing outlet 36. The housing outlet 36 is coupled to an exhaust pipe 112 which delivers the material to a cyclone 114 for material and air separation. The diameter of the exhaust pipe 112 may range from approximately 4" (100 mm) to 7" (177 mm). It may be necessary to exceed this given range for certain materials such as attapulgite or coal where a 8" (203 mm) exhaust pipe 112 is appropriate. Although referred to as a pipe, one of skill in the art will appreciate that the exhaust pipe 112 may have a cross-section of various shapes, i.e. rectangular, octagonal, etc. and various diameters and still be within the scope of the invention.

The exhaust pipe 112 may have a length of approximately 12 feet to 16 feet. The diameter size of the exhaust pipe 112 impacts the amount of drying that further occurs. High air volume is required for further drying of materials. In the exhaust pipe 112, the faster moving air in the exhaust pipe 112 passes the material and removes moisture remaining on the material. The air and vapor travel to a cyclone 114 where air and vapor are separated from the solid material.

A pulverization event generates heat that assists in drying the material. In addition to pulverization, rotation of the airflow generator 32 generates heat. The dimensions between the housing 35 and the airflow generator 32 are such that during rotation the friction generates heat. The heat exits through the housing outlet 36 and exhaust pipe 112 and further dehydrates the material as the material travels to the cyclone 114. The generated heat may also be sufficient to partially sterilize the material in certain applications.

The diameter of the housing outlet 36 may be increased or decreased to adjust the resistance and the amount of heat traveling through the housing outlet 36 and exhaust pipe 112. The diameter of the exhaust pipe 112 and the housing outlet 36 effects the removal of moisture on pulverized material. Adjusting the outlet diameter is further discussed below.

The pulverization and moisture extraction increases as the airflow generated by the airflow generator 32 increases. If airflow is increased or decreased, the diameter of the exhaust pipe 112 and housing outlet 36 may be decreased to provide the same material dehydration. Thus, the airflow and diameters may be adjusted relative to one another to achieve the desired dehydration.

Heavier materials with less water, such as rock materials, require less moisture extraction. With such materials, the housing outlet 36 and exhaust pipe 112 diameters may be increased as less drying is required. Consequently, with wetter materials, the housing outlet 36 and the exhaust pipe 112 diameters may be decreased to increase the amount of air and heat to achieve the proper dehydration of the material.

The angle of inclination of the exhaust pipe 112 relative to the longitudinal axis of the venturi 18 and airflow generator 32 also effects dehydration performance. The exhaust pipe angle ∀ may be approximately 25 degrees to approximately 90 degrees in order to enhance moisture extraction. Material traveling upward is held back by gravity whereas air is less restricted by gravity. This allows the air to move faster than the material and increase moisture removal. The angle ∀ may be adjusted to increase or decrease the effect on moisture extraction. The exhaust pipe 112 may be straight as illustrated or curved as shown in phantom.

The cyclone 114 is a well known apparatus for separating particles from an airflow. The cyclone 114 typically includes a settling chamber in the form of a vertical cylinder 116. Cyclones can be embodied with a tangential inlet, axial inlet, peripheral discharge, or an axial discharge. The airflow and particles enter the cylinder 116 through an inlet 118 and spin in a vortex as the airflow proceeds down the cylinder 116. A cone section 120 causes the vortex diameter to decrease until the gas reverses on itself and spins up the center to an outlet 122. Particles are centrifuged toward the interior wall and collected by inertial impingement. The collected particles flow down in a gas boundary layer to a cone apex 124 where it is discharged through an air lock 126 and into a collection hopper 128.

In certain applications, the system 100 may further include a condenser 130 to receive the airflow from the cyclone 114. The condenser 130 condenses the vapor in the airflow into a liquid which is then deposited in a tank 132. An outlet 134 couples to the condenser 130 and provides an exit for air. As can be appreciated, the condenser 130 has particular application with food processing. In an alternative embodiment, the condenser 130 is embodied as an alternative treatment device such as a charcoal filter or the like. As can be appreciated, condensation or filtering will depend on the material and application. The outlet 134 may include or couple to a filter (not shown) to filter residue, particles, vapor, etc. from the outputted air. The filter may be sufficient to comply with government regulatory standards to provide a negligible impact on the environment.

Passing material through the system 100 multiple times will further dehydrate material and will further reduce particle size. In municipal waste applications, multiple cycles through the system 100 may be required to achieve the desired dehydration results. The present invention contemplates the use of multiple systems 100 in series to provide multiple venturis 18 and multiple pulverization events. Thus, a single cycle through multiple systems 100 in series achieves the desired results. Alternatively, material may be processed and reprocessed by the same system 100 until the desired particle size and dryness is achieved.

In one implementation, the resulting product issuing from a system 100 is analyzed to determine the size of the powder granules and/or the moisture percentage. If the product fails to meet a threshold value for size and/or water percentage the product is directed through one or more cycles until the product meets the desired parameters.

The present invention allows homogenization of different materials. In operation different materials enter the inlet tube 12 together, are processed through the venturi 18, and undergo pulverization. The resulting product is blended and homogenized as well as being dehydrated and reduced in size.

A particular application of the present invention involves the homogenization of landfill product with coal. After pulverization and water extraction, the combined and homogenized waste and coal product is used in a coal burner to achieve optimum burning rates for creating steam in an electrical generation plant. The waste is used for energy production rather than for routine disposal.

If desired, the material may be mixed in the blender 102 prior to pulverization or at an intermediate stage between pulverization events. Mixing materials may enhance homogenization with certain materials. If desired, the material may be mixed in the blender 102 prior to pulverization or at an intermediate stage between pulverization events.

Materials blended in a preprocessing stage may be cycled through multiple pulverizing stages to provide the desired homogenization. A first material may be processed through multiple pulverizing stages and then homogenized with a second material. Between pulverizing stages the second material may be blended with the processed material in a preprocessing stage. The first and second materials are then passed through one or more pulverizing stages to produce a homogenized, final product.

As an additional example, a first material may cycle through three pulverizing stages. After the third pulverizing stage, a second material may be blended together in a blender 102. Before mixing, the second material may have passed through a venturi 18 for pulverization and reduction to a desired particle size. The first and second materials may then pass together through one or more additional pulverizing stages to provide the desired moisture content, size, and homogenization for industrial use.

Figure 6:
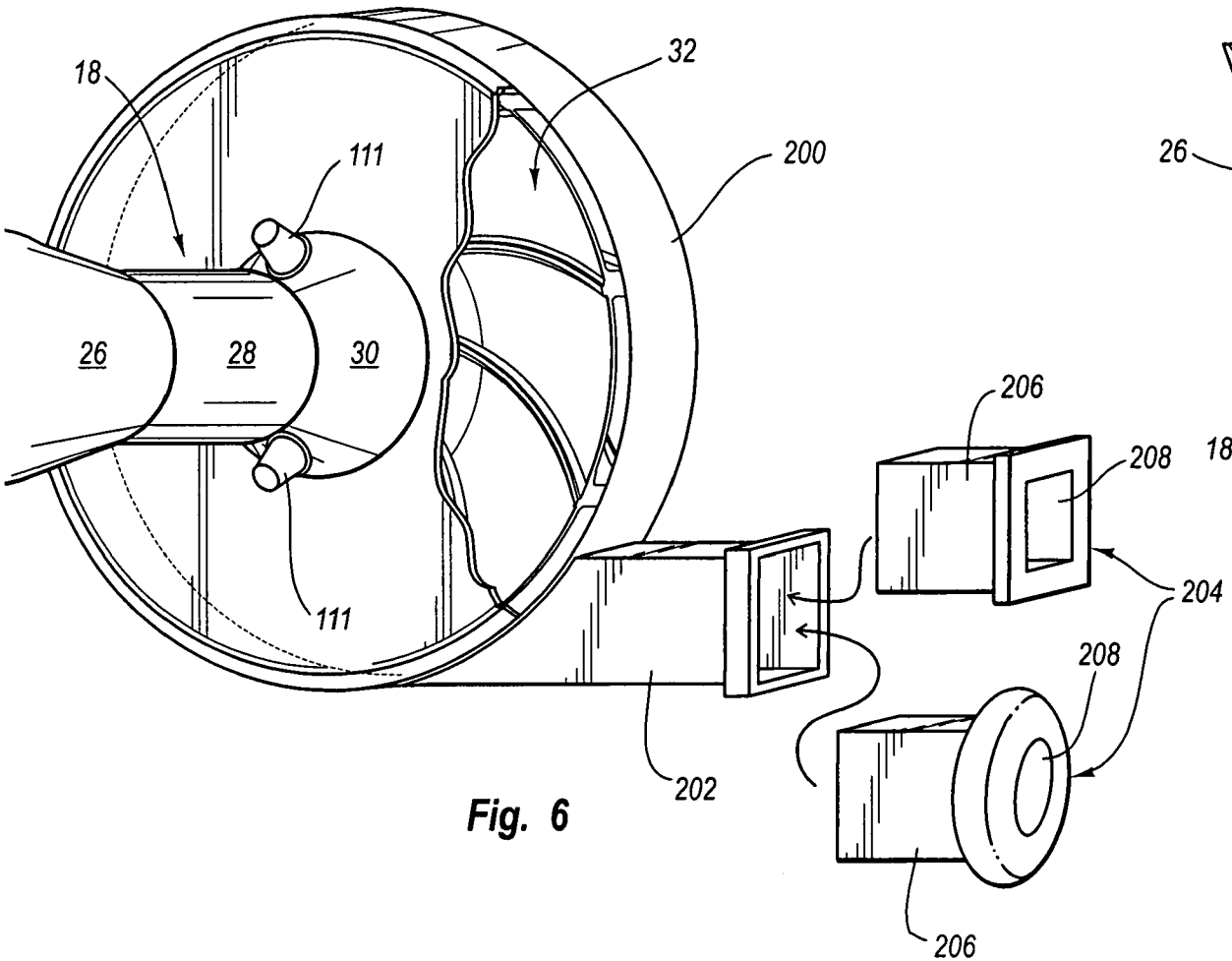
FIG. 6 is a perspective view illustrating an air generator housing and outlet restrictors.

Referring to FIG. 6, a perspective view is shown of a housing 200 that includes a housing outlet 202. The housing 200 encompasses the operational components of an airflow generator 32. The housing 200 is shown with a cut-away section to illustrate the airflow generator 32 within. In order to provide variance in the output flow, a restrictor 204 may be introduced into the housing outlet 202. A restrictor 204 increases the resistance to the airflow and also increases heat. Varying the amount of resistance and airflow is dependent on the material to be processed.

A restrictor 204 includes a neck 206 to nest within the housing outlet 202 and a restrictor aperture 208. The restrictor aperture 208 has a cross-section less than that of the housing outlet 202. A restrictor aperture 208 may be rectangular, circular, or have another suitable shape. The neck 206 provides a converging flow path from a cross-section approximating that of the outlet 202 to the final cross-section of the restrictor aperture 208. A number of restrictors 204 with varying aperture sizes may be available to manipulate the output flow and thereby tune the system 100 to suit the material.

Figure 7:
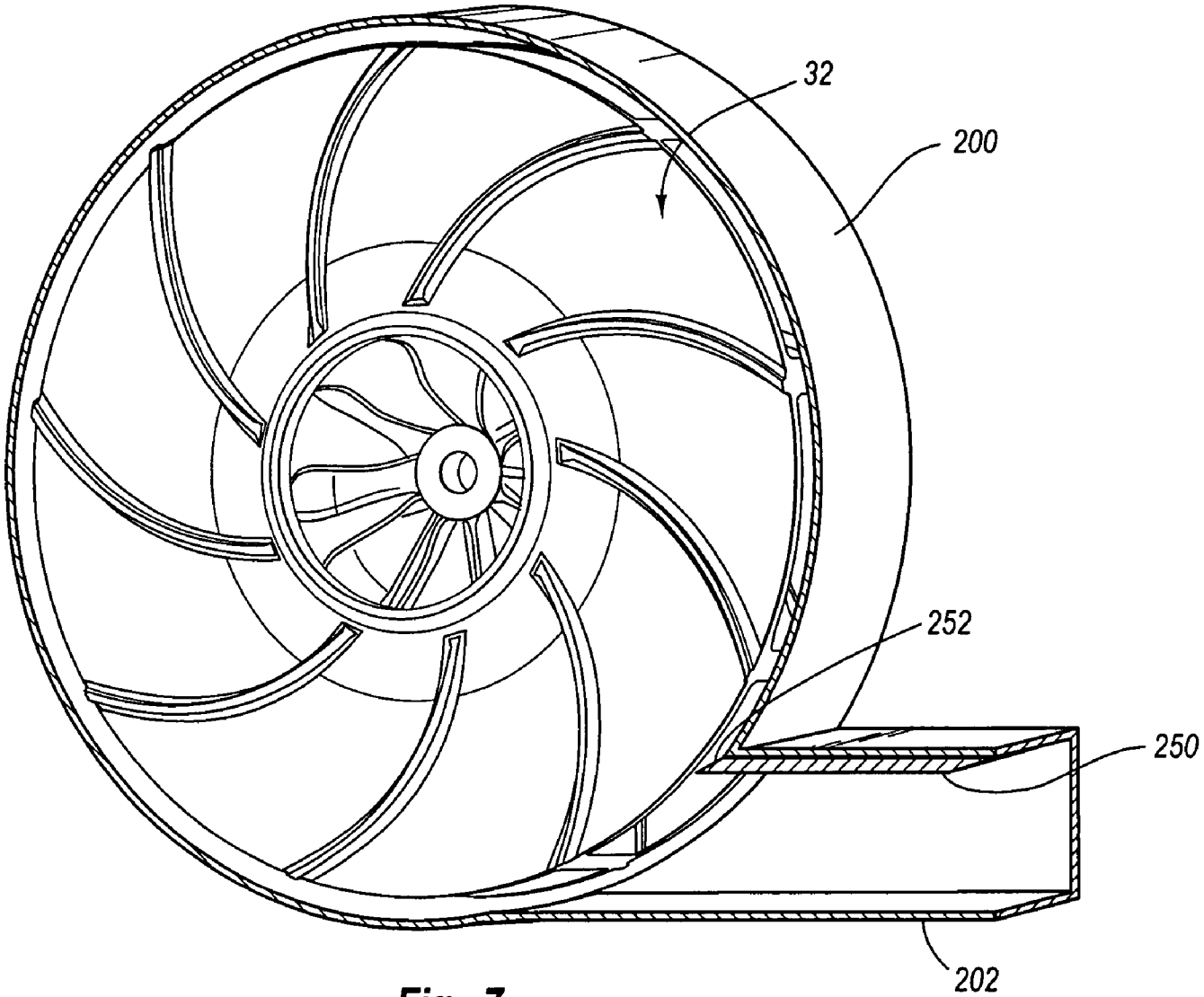
FIG. 7 is a cross-sectional view of one embodiment of an air generator housing.

Referring to FIG. 7, a cross-sectional view of an airflow generator 32 within a housing 200 is shown. The airflow generator 32 may not be coaxially aligned within the housing 200. In one implementation, the airflow generator 32 includes a diverter plate 250 that has a cutting edge 252 near the airflow generator 32. The cutting edge 252 of the diverter plate 250 directs pulverized material into the housing outlet 202. The diverter plate 250 is coupled to the interior of the housing 200 and may be coupled to the interior of the housing outlet 202.

The diverter plate 250 prevents pulverized material from further rotation within the housing 200. As such, the diverter plate 250 serves as the first separation of pulverized material from air that continues to rotate within the housing 200. Subsequent separation of pulverized material from air is performed by the cyclone 114. If pulverized materials continue to rotate within the housing 200 the pulverized materials may build up and eventually obstruct the airflow generator 32. The cutting edge 252 varies the airflow volume proceeding through the housing 200.

The separation of the cutting edge 252 of the diverter plate 250 from the airflow generator 32 may range from about 20 thousandths of an inch to 100 thousandths of an inch. The position of the diverter plate 250 may also be adjustable to increase or decrease the separation from the airflow generator 32. Adjustment may be required depending on the materials being processed or to manipulate airflow volume. Adjustment may be controlled by the central processor 110 which communicates with an electromechanical or pneumatic device for moving the diverter plate 250. The cutting edge 252 has a bevel that accommodates the shape of the airflow generator 32.

Figure 8:
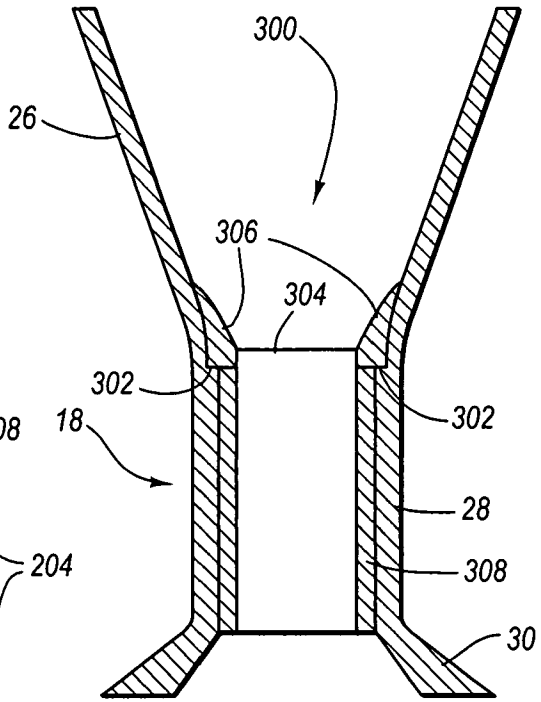
FIG. 8 is cross-sectional view of a venturi and a throat resizer.

Referring to FIG. 8, a cross-sectional view of a venturi 18 with an accompanying throat resizer 300 is shown. The throat resizer 300 is a removable component that, when inserted, nests within the throat 28. The throat resizer 300 alters the effective diameter of the throat 28 and increases the air velocity. Variance of the throat diameter is required depending on the material and the desired dehydration and particle reduction. Thus, although the airflow generator 32 may vary the airflow, it is further desirable to manipulate throat diameter of venturi 18.

The throat 28 may be configured with a ledge 302 upon which a collar 304 of the throat resizer 300 nests. A crown member 306 is coupled to the collar 304 and conforms to the interior surface of the converging portion 26. The throat resizer 300 includes a sleeve 308 that conforms to the interior surface of the throat 28 and extends within a major portion of the venturi throat length to resize the venturi 18.

Figure 9:
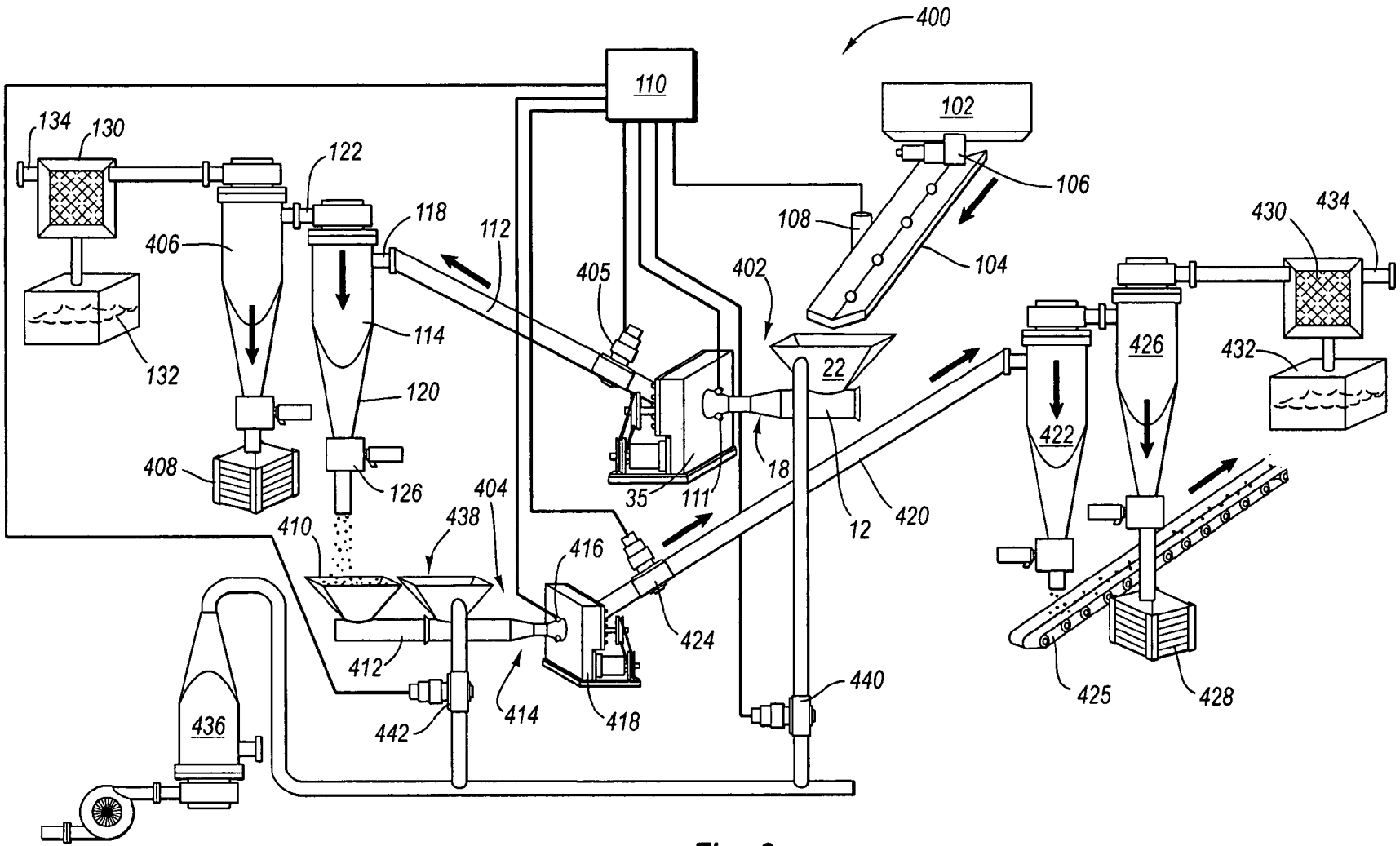
FIG. 9 is a block diagram illustrating the components of an alternative embodiment of a pulverizing system.

Referring to FIG. 9, an alternative embodiment of a system 400 is shown that incorporates two pulverizing stages 402, 404. Each time material passes through a venturi 18, pulverization occurs, moisture is extracted, and particle reduction occurs. As discussed previously, this process may be repeatedly performed with a single venturi 18 or with multiple venturis 18 in series until the desired amount of water is extracted and product size is achieved. This process may be continued until nearly 100 percent water extraction is achieved.

Although two pulverizing stages are shown with the system 400, one of skill in the art will appreciate that a system may include three, four, five, or more stages. The first pulverizing stage 402 is similar to that previously described in reference to FIGS. 4 and 5. The first pulverizing stage 402 includes a hopper 22, blender 102, conveyance device 104, flow control valve 106, venturi 18, housing 35 (with an airflow generator 32 within), and an exhaust pipe 112. The system 400 may further include a flow control valve 405 in the exhaust pipe 112 to regulate airflow within.

As in the previous embodiments, the exhaust pipe 112 couples to a cyclone 114 to separate the processed product from the air. The system 400 may further include a second cyclone 406 to receive air from the outlet 122 of the first cyclone 114. The second cyclone 406 further separates air from residual particles and delivers the purified air to a condenser 130. A first tank 132 is in communication with the second cyclone 406 to receive condensed liquid from the condenser 130. An outlet 134 provides an exit for air passing from the condenser 130 and the second cyclone 406. A residual hopper 408 is positioned to receive residual particles from the second cyclone 406.

Particles separated by the first cyclone 114 are delivered to a hopper 410 using any number of conventional techniques including gravity. Although not shown, particles from both the first and second cyclones 114, 406 may be delivered to the hopper 410. The hopper 410 receives the particles that then undergo the second pulverizing stage 404. The hopper 410 delivers the particles to a second inlet tube 412 that is coupled to a second venturi 414 as with the first pulverizing stage 402.

One or more flow valves 416 are located on the second venturi 414 and are in electrical communication with the central processor 110. The flow valves 416 function similar to those previously described and referenced as 111.

The second venturi 414 communicates with a second airflow generator (not shown) in a housing 418. The second airflow generator generates a high speed airflow through the venturi 414. The second housing 418 couples to a second exhaust pipe 420 that delivers air and processed material to a third cyclone 422. The second exhaust pipe 420 is inclined at an angle of approximately 25 degrees to approximately 90 degrees relative to the longitudinal axis of the second venturi 414. A second flow control valve 424 is within the second exhaust pipe 420 to regulate airflow within. As with the first flow control valve 404, the second flow control valve 424 is in electrical communication with the central processor 110 for regulation.

The third cyclone 422 separates the particles from the air and delivers a product that is delivered to another conveyance device 425. A fourth cyclone 426 receives air from the third cyclone 422 and further purifies the air and removes residual particles. Residual particles from the fourth cyclone 426 are deposited in a residual hopper 428. The fourth cyclone 426 delivers air to a second condenser 430 where vapor is condensed into a liquid and received by a second tank 432. An outlet 434 couples to the second condenser 430 to allow air to exit.

The system 400 further includes a heat generator 436 to provide heat through the inlet tubes 12, 412 and the venturis 18, 414 and assist in drying materials. The addition of heat is not required for water extraction and is merely used to further increase the drying potential of the present invention. The heat generator 436 may communicate with the hoppers 22, 438 or with the inlet tubes 12, 412. A heat generator 436 may also be used in a similar manner in the embodiments illustrated in FIGS. 1, 2, 4, and 5.

In FIG. 9, the heat generator 436 is in communication with a first heat control valve 440 to deliver heat to the first hopper 22. The first heat control valve 440 is in electrical communication with the central processor 110 to regulate the heat delivery. Alternatively, the heat control valve 440 may be operated manually. The heat generator 436 is further in communication with a second heat control valve 442 that regulates heat flow to hopper 438. Heating material during the second pulverizing stage 404 may be desired depending on the material or the application. If heating is desired, the hopper 438 receives particles from the first cyclone 114. Otherwise, the material may pass to the hopper 410 as illustrated in FIG. 9.

One of skill in the art will appreciate that the system 400 may be varied to include or remove several components and still be well within the scope of the invention. The system 400 may include one or more pulverizing stages for further dehydration and particle reduction. The conveyance device 425 may feed back into the blender 102 or the hopper 22 for further cycling of product through the pulverizing stages 402, 404. The second and fourth cyclones 406, 426 provide further purification of air but the added cost may not be justified for certain applications. In certain applications the condensers 130, 430 may be removed or another type of treatment apparatus, such as a filter, be used. Flow control valves may also be introduced or removed throughout the system 400 as warranted and as based on design constraints. Thus, the system 400 should be considered as illustrative of one implementation of the present invention and should not be deemed to limit variations thereto.

Figure 10:
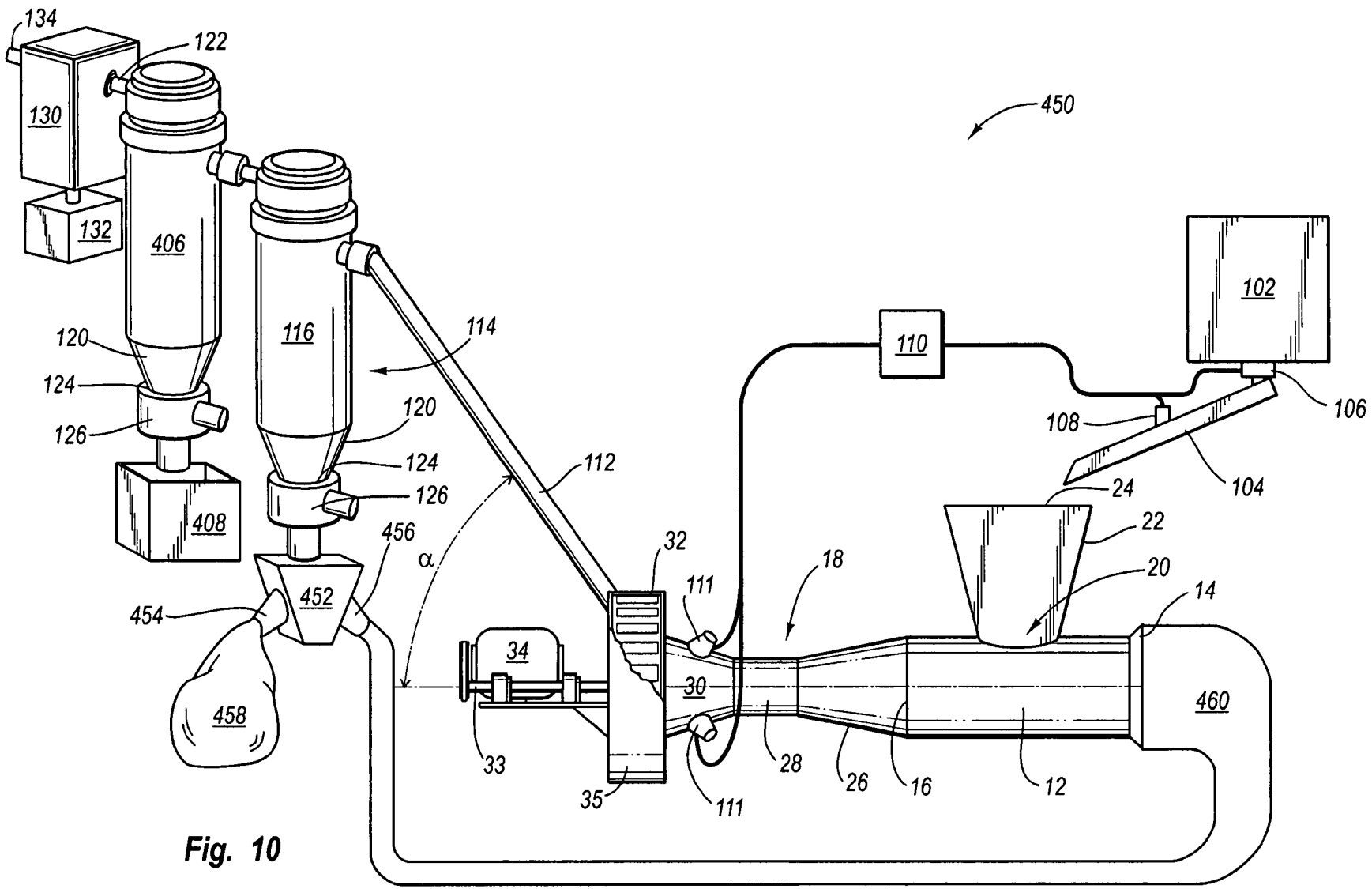
FIG. 10 is a block diagram illustrating an alternative embodiment of a pulverizing system of the present invention.

Referring to FIG. 10 an alternative embodiment of a pulverization and moisture extraction system 450 is shown. The system 450 is similar to that of FIGS. 4 and 5 and further includes a second cyclone 406 in communication with the first cyclone 114, a residual hopper 408 to collect particles from the second cyclone 406, a condenser 130 in communication with the second cyclone 406, a tank 132 in communication with the condenser 130, and an outlet 134 coupled to the condenser 130. The system 450 further includes a diverter valve 452 coupled to the first cyclone 114.

The diverter valve 452 directs particles received from the first cyclone 114 to a first outlet 454 or a second outlet 456. The first outlet 454 is coupled to a collector 458 such as a bag, hopper, tank, or the like. The second outlet 456 is coupled to a recycling tube 460 to introduce the pulverized material through the system 450 again. The recycling tube 460 is coupled at its opposing end to the first end 14. Alternatively, the recycling tube 460 may direct pulverize material into the hopper 22 or directly into the elongated opening 20.

In operation, material is pulverized as it passes through the system 450 and is redirected, by control of the diverter valve 452, to pass through the system 450 again for another pulverization event. This may be repeated as desired until a final product results which is then directed by the diverter valve 452 into the collector 458.

Figure 11:
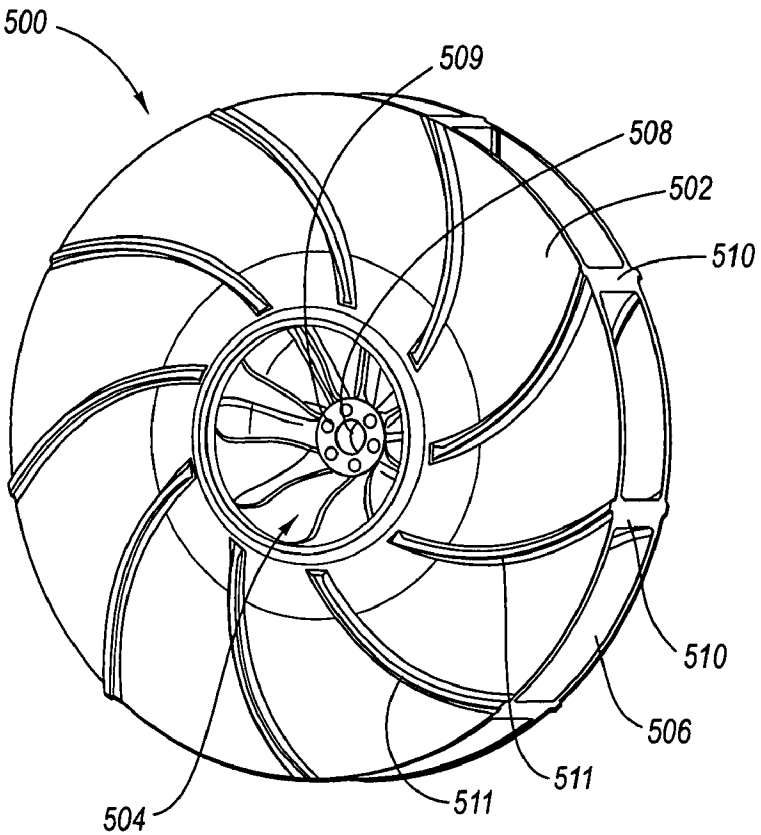
FIG. 11 is a perspective view of one embodiment of an airflow generator suitable for use with a system of the present invention.

Referring to FIG. 11, an embodiment of an airflow generator 500 suitable for the present invention is shown. Various metals are suitable for the airflow generator, depending on the material to be processed. For abrasive material, a harder alloy steel may be used. As can be appreciated by one of skill in the art, the material selected is a balance between strength and anticipated wear. Casting of the airflow generator 500 is advantageous as fabrication via welding creates inconsistent surfaces and heat effected areas due to heat effected zones. The cast airflow generator 500 may have a variable material thickness to resist rapid structural impacts and accelerated wear resulting from processing various materials. The section thickness and resulting total weight of the airflow generator 500 is directly proportional to the air volume and material flow rate that is to be processed.

The airflow generator 500 is received within a housing such as that illustrated in FIG. 6. The housing 200 at least partially encircles the airflow generator 500 and preferably completely encircles the airflow generator 500 so that the only egress is the housing outlet 36. The airflow generator 500 may have a close clearance to the housing 200 to generate additional friction and heat. The heat is desired to assist in further drying materials passing through the airflow generator 500 and into the exhaust pipe 112.

The airflow generator 500 includes a front plate 502 with a concentrically disposed input aperture 504 to receive incoming materials. The diameter of the input aperture 504 is variable depending on the processed material size and anticipated air volume. A back plate 506 parallels the front plate 502 and includes a concentrically disposed axel aperture 508. As the name suggests, the axel aperture 508 receives and engages an axel or spindle to power rotation. Alternative airflow generators 500 may be used with the present invention and include generators with a single back plate coupled to blades or generators with radially extending blades alone.

The back plate 506 may further include bolt apertures 509 that are disposed concentrically around the axel aperture 508. The bolt apertures 509 each receive a corresponding axel bolt (not shown) that are each coupled to an axel. The axel bolts are secured to back plate 506 by nuts or other conventional devices.

Although the thickness of the front and back plates 502, 506 may vary considerably, in one design the back plate 506 is approximately ⅜" (8 mm) and the front plate 502 is 3/16" (5 mm). Specific measurements are given as examples and should not be deemed limiting of the present invention.

A plurality of blades 510 are disposed between the front and back plates 502, 506 and are coupled to both plates 502, 506. As can be appreciated, the number of blades 510 may vary and depends, in part, on the material to be processed. The thickness of the blades 510 may also vary depending on the material to be processed.

In one embodiment, the blades 510 extend through the front and back plates 502, 506 to form blade fins 511 on the exterior face of the front and back plates 502, 506. The blade fins 511 may extend approximately ½" (12 mm) from either the front or back plates 502, 506. The blade fins 511 generate a cushion of air between the airflow generator 500 and the interior of the housing 200. The blade fins 511 further act to clean out materials that may enter between the housing 500 and the airflow generator 200.

Figure 12:
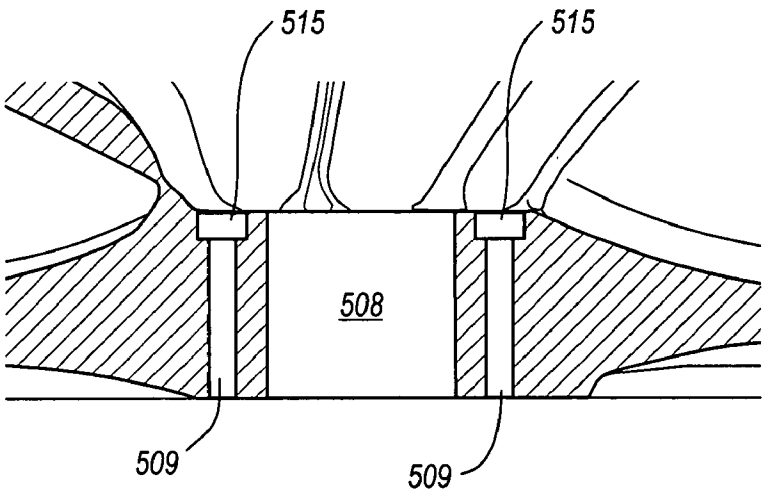
FIG. 12 is a cross-sectional view of a portion of the airflow generator of FIG. 11.

Referring to FIG. 12, a cross-sectional view of the axel aperture 508 is shown. The axel aperture 508 receives an axel, shaft, spindle, or other member to rotate the airflow generator 500. The bolt apertures 509 each receive an axel bolt to secure the back plate 506. In this embodiment, an axel transitions from a first diameter, with axel bolts extending, to a second diameter suitable for insertion into the axel aperture 508. The bolt apertures 509 may each provide a well 513 to receive a nut that engages an axel bolt.

Figure 13:
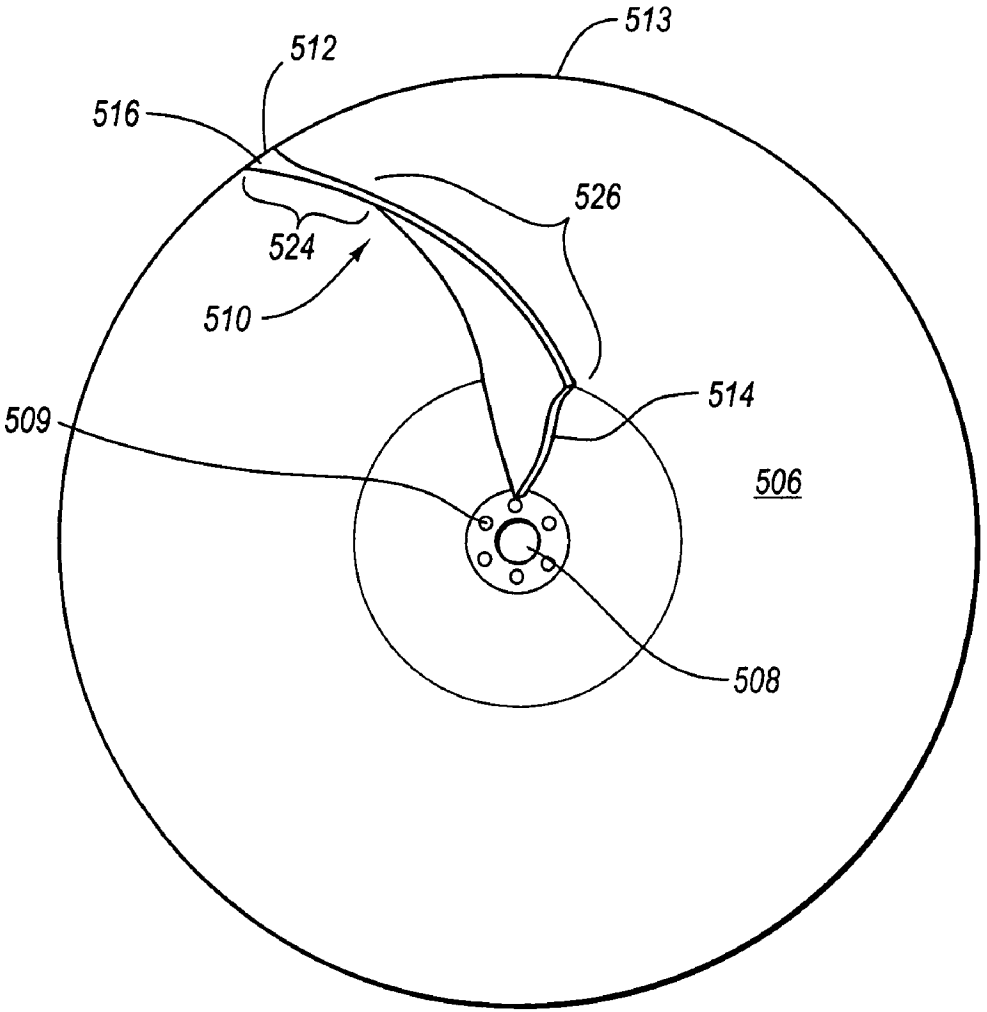
FIG. 13 is a plan view of an interior portion of the airflow generator of FIG. 11.

Referring to FIG. 13, a plan view of the interior of the airflow generator 500 is shown with a single blade 510. The single blade 510 is shown to illustrate the unique features of blades 510 incorporated within the airflow generator 500. The remaining blades 510 are similarly embodied.

The blade 510 extends from a tail edge 512 at the perimeter 513 of the back and front plates 502, 506 to a leading edge 514 adjacent the axel aperture 508. The blade 510 includes a wedge portion 516 adjacent the tail edge 512. The wedge portion 516 has a thicker cross-section to increase pressure and airflow volume. The wedge portion 516 provides increased resistance to wear which is advantageous with some materials.

Figure 14A:
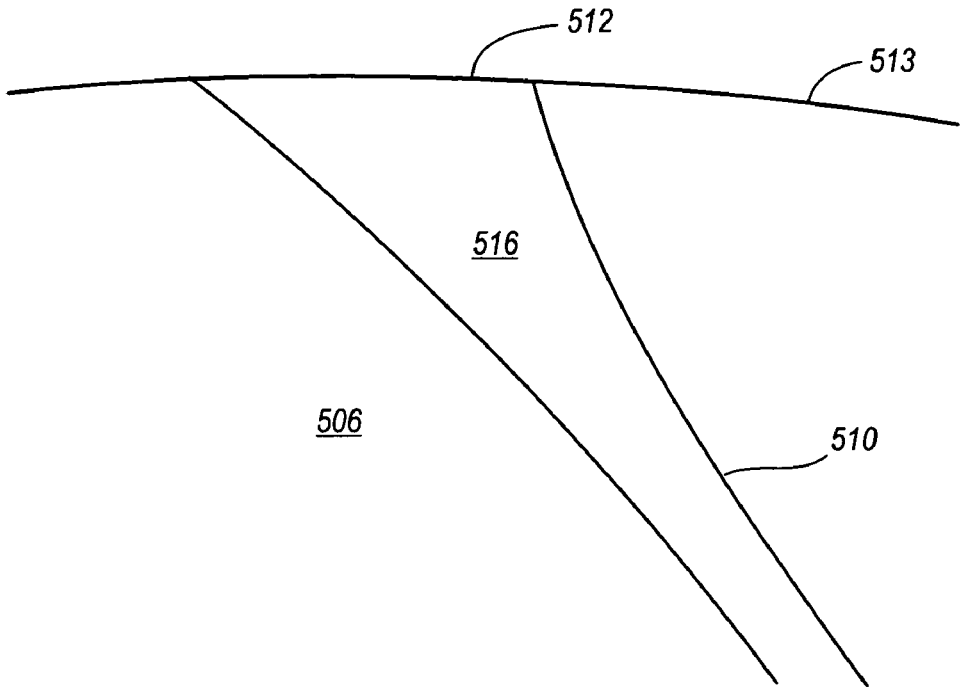
FIG. 14A is a plan view of a tail edge of a blade of the airflow generator of FIG. 11.

Referring to FIG. 14A, a plan view illustrating the wedge portion 516 in greater detail is shown. The shape of the wedge portion 516 affects airflow volume, airflow velocity, and material flow rate through the airflow generator 500. The wedge portion 516 may be altered in the circumferential and longitudinal direction to alter airflow volume, airflow velocity, and material flow rate. Casting techniques advantageously allow variance in three dimensions and allows any number of circumferential and longitudinal profiles in the wedge portion 516.

The increased thickness of the wedge portion 516 enhances the life of the airflow generator 500 as this is where the blade 510 typically experiences the most wear. The material used and the hardness of the wedge portion 516 may also differ from the remainder of the blade 510.

Figure 14B:
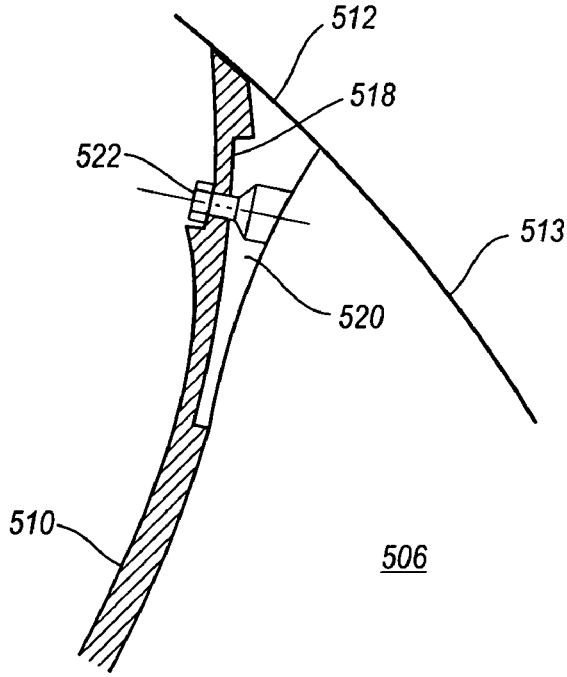
FIG. 14B is a plan view of an alternative embodiment of a tail edge of a blade of the airflow generator of FIG. 11.

Referring to FIG. 14B, an alternative embodiment of a wedge portion 518 is shown which includes a replaceable wear tip 520. With the airflow generator 500 rotating in a clockwise direction, the replaceable wear tip 520 is subject to the most material contact. Although thickened to increase wear resistance, the wedge portion 518 is subject to more wear than other components of the airflow generator 500 and may wear out sooner. By replacing the replaceable wear tip 520, replacement of the entire airflow generator 500 is deferred. The replaceable wear tip 520 is coupled to the remainder of the wedge portion 518 through any known fastening device including a securing nut and bolt assembly 522. The replaceable wear tip 520 may be a material harder than the remainder of the blade 510. The replaceable wear tip 520 may also be replaced with a replaceable wear tip 520 having a different circumferential and longitudinal profile. In yet another embodiment, the entire wedge portion 518 is replaceable.

Figure 15A:
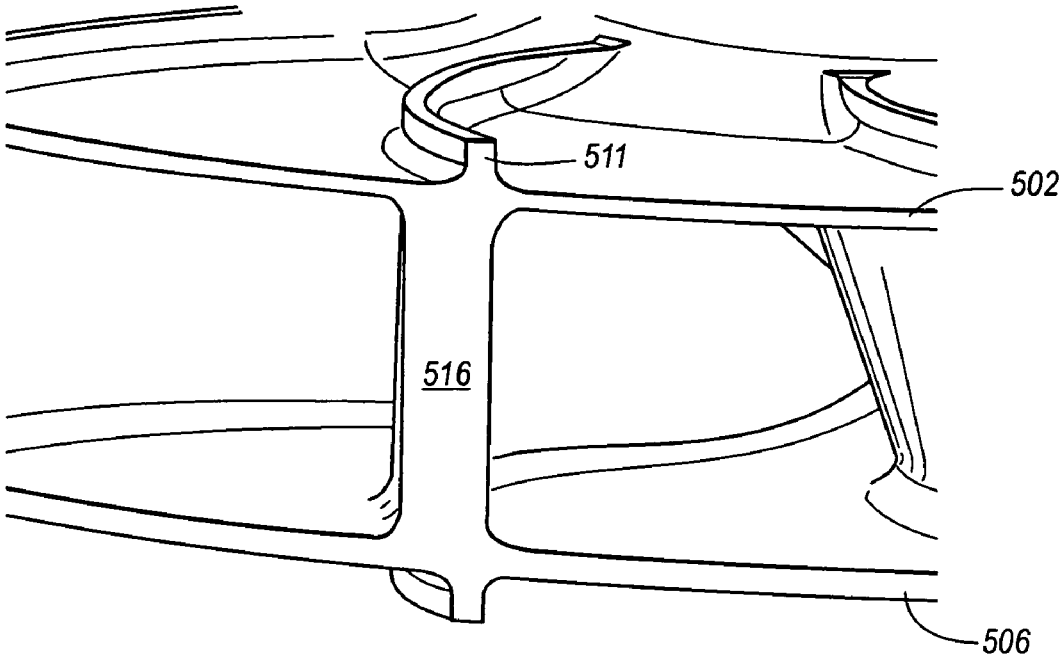
FIG. 15A is a perspective view of a portion of the airflow generator of FIG. 11.

Referring to FIG. 15A, a perspective view of the airflow generator 500 is shown illustrating the wedge portion 516 coupled to the front and back plates 502, 506. The blade fins 511 are further shown extending from the exterior surface of the front and back plates 502, 506. As shown, the wedge portion 516 is substantially thicker than the corresponding blade fins 511. The blade fins 511 are not subject to the same wear as the wedge portion 516 and are not as thick.

Figure 15B:
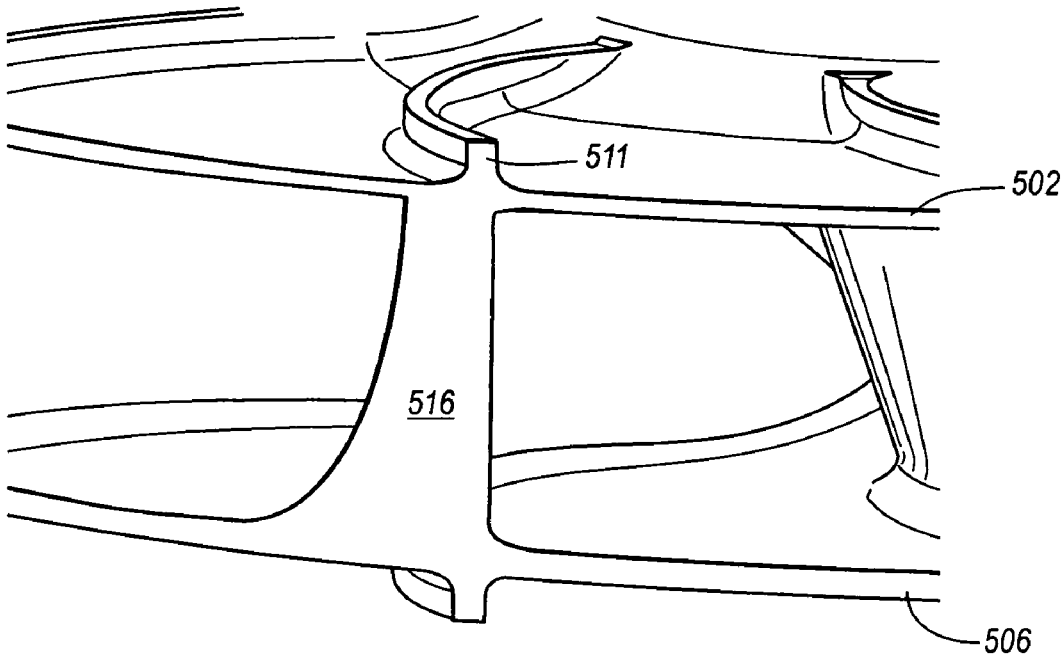
FIG. 15B is a perspective view of a portion of an alternative embodiment of an airflow generator of FIG. 11.

Referring to FIG. 15B a perspective view of the airflow generator 500 is shown with an alternative embodiment of the wedge portion 516. The wedge portion 516 increases its thickness and its circumferential profile as it extends in the longitudinal direction from the front plate 502 to the back plate 506. The wedge portion 516 also increases in thickness as it extends radially towards the perimeter.

Pulverized material entering into the airflow generator 500 has a tendency to accumulate proximate to the back plate 506. The longitudinally increasing thickness encourages pulverized material to remain centered between the front and back plates 502, 506 rather than accumulating along the back plate 506. Casting techniques enable production of such a wedge portion 516 as three dimensional variation is possible. The replaceable wear tip 520 may include and define the longitudinally increasing thickness. If another wedge portion 516 shape is desired another replaceable wear tip 520 without a longitudinally increasing thickness or a more pronounced longitudinally increasing thickness may be used. Thus, pulverized material flow direction may be manipulated longitudinally by using wedge portions 516 of different circumferential and longitudinal configurations.

Referring again to FIG. 13, the blade 510 transitions from a position perpendicular to the back plate 506 to an angled position. The blade 510 transitions as it proceeds from the wedge portion 516 to a location prior to the leading edge 514. The angled position causes the blade 510 to pitch into the direction of the airflow.

In the illustrated embodiment, a tail portion 524 of the blade 510, including the wedge portion 516, extends perpendicular from the back plate 506. The tail portion 524 may be approximately one fourth to one half of the blade 510 as the blade 510 extends from the tail edge 512 to the leading edge 514. A leading portion 526 is the remaining amount of the blade 510 from the tail portion 524 to the leading edge 514. The illustrated leading portion 526 has an angled transition from a perpendicular position relative to the back plate 506 to an angled position.

The angled position has an angle that is referred to herein as the attack angle as it allows the leading edge 514 to cut into the incoming airflow. In FIG. 13, the final attack angle of the blade 510 at the leading edge 514 is approximately 25 degrees. The transition from a perpendicular position to an angled position may extend over the entire blade 510 or any portion thereof. The attack angle may be selected from a broad range of angles based on anticipated airflow velocity, material flow rate, and material. The angled position may have a range of approximately 20 to 60 degrees.

Alternatively, the blade 510 may remain perpendicular along its entire length. The blade 510 may also have an attack angle along its entire length. Although extending along the entire length, the attack angle may still vary as the blade 510 extends from the tail edge 512 to the leading edge 514.

Figure 16:
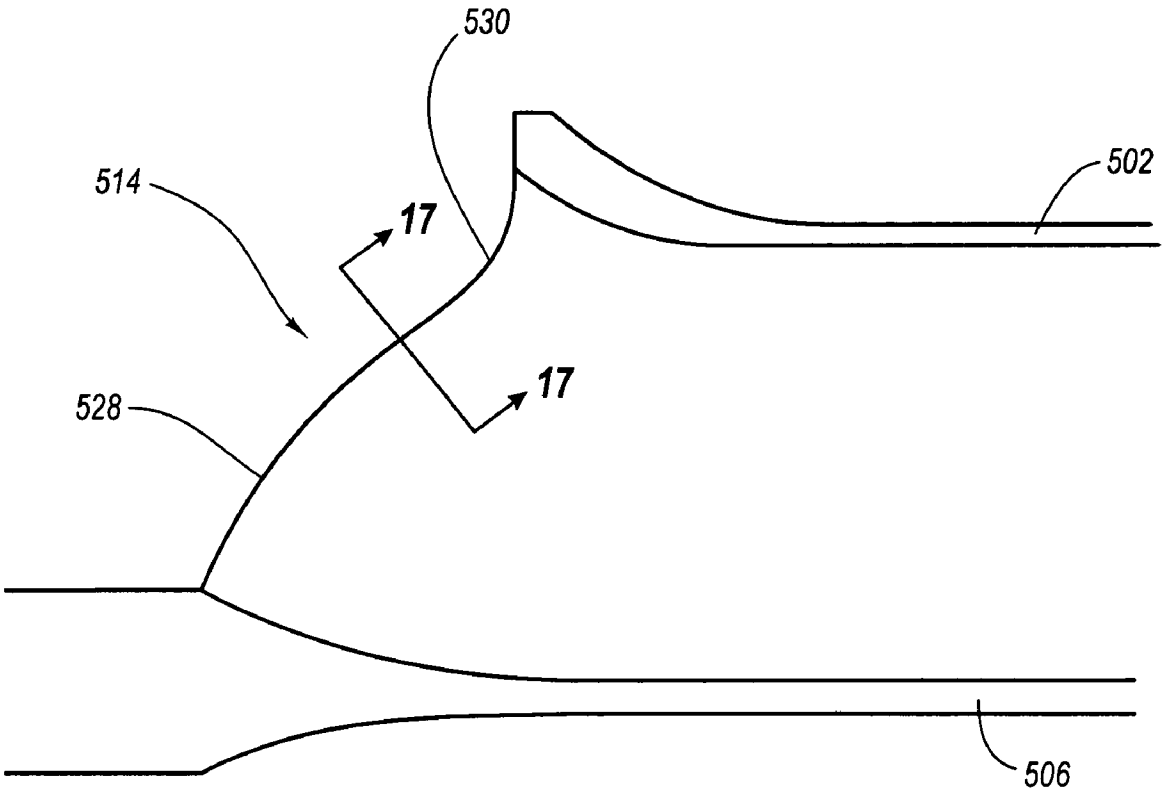
FIG. 16 is a side view of a blade of the airflow generator of FIG. 11.

Referring to FIG. 16, a profile view of the leading edge 514 is shown. Conventionally, an edge may be relatively straight and proceed on an angle relative to the back plate 506. In one embodiment of the present invention, the leading edge 514 proceeds from the back plate 506 with an outwardly curving portion 528 and then transitions into an inward curve 530. The outwardly curving portion 528 assists in capturing air traveling into the input aperture 504 of the airflow generator 500. The leading edge 514 so profiled is able to cut into air and improve the efficiency of the airflow generator 500.

Figure 17:
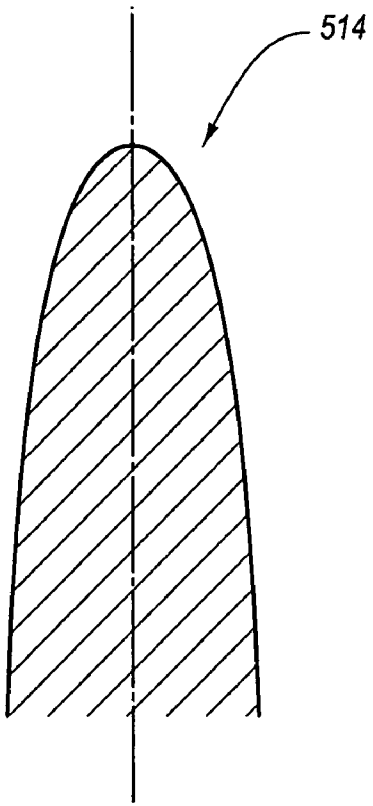
FIG. 17 is a cross-sectional view of the blade of FIG. 16.

Referring to FIG. 17 a cross section of the leading edge 514 taken along section 17—17 is shown. The leading edge 514 has an oval shaped cross-section that assists in slicing into incoming airflow.

Figure 18:
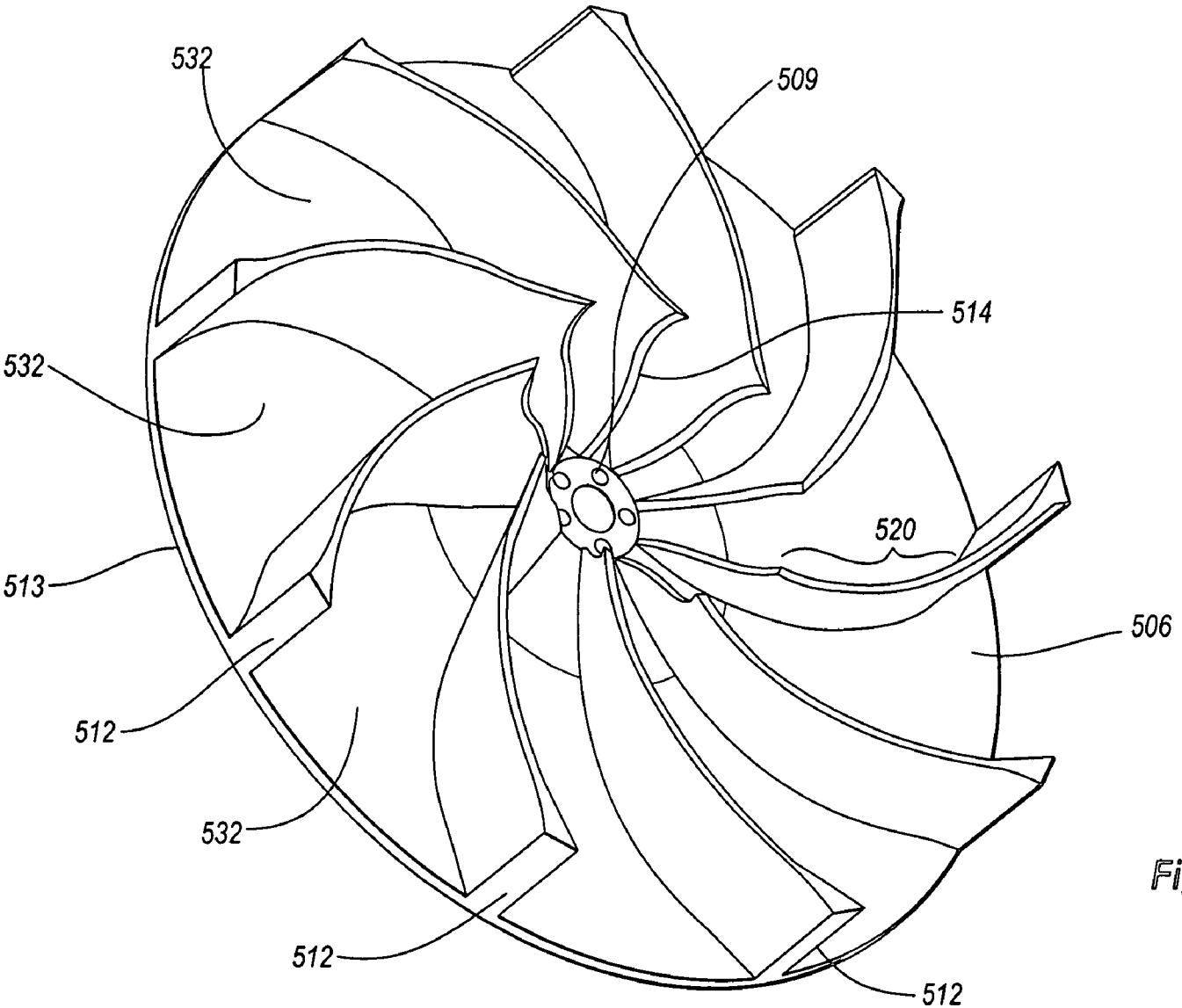
FIG. 18 is a perspective view of a portion of the airflow generator of FIG. 11.

Referring to FIG. 18, a perspective view of the airflow generator 500 is shown without the front plate 502 to illustrate the blades 510. The illustrated embodiment includes nine blades 510 although the number is variable. Each blade 510 includes a wedge portion 516 for added resistance to wear and to increase pressure and airflow. Each blade 510 further transitions from a perpendicular position to an attack angle. The attack angle inclines towards the clockwise position that corresponds to the anticipated rotation of the airflow generator 500. One of skill in the art will appreciate that the airflow generator 500 may be operated in the counter-clockwise position and the blades 510 would be inclined in that direction.

In operation, the rotating blades 510 generate a high speed airflow ranging from 350 mph or greater and directs air and pulverized material into the input aperture 504. The leading edges 514 of the blades 510 cut into the air and pulverized material and direct both the air and pulverized material into flow paths 532 defined by the blades 510 and extending from the input aperture 504 to the perimeter 513 of the front and back plates 502, 506. The flow paths 532 would have a maximum flow rate for materials passing through. The wedge portions 516 push the air and pulverized material to the housing outlet 202 that is located within the housing 200. Although the airflow generator 500 provides unique features, one of skill in the art will appreciate that any number of devices may be used and are included within the scope of the invention.

The present invention provides a pulverizing and dehydrating system that can accommodate various materials and various flow rates. The systems described herein are scalable for the different applications and different sized materials and any specific component dimensions are given only as examples. Thus, a system may be sized as a bench-top model or as a large industrial-sized unit.

The systems 10, 100, 400, 450 disclosed herein may be mounted to a ground surface and larger scale embodiments are more likely to be so constructed. Alternatively, a system may be mounted within or on a vehicle such as a truck, trailer, rail car, boat, barge, and so forth. Any vehicle that provides a sufficient planar footprint may be used. Having a mobile system is advantageous in certain applications such as agricultural harvesting, remote site treatments, demonstrations, and so forth.

Figure 19:
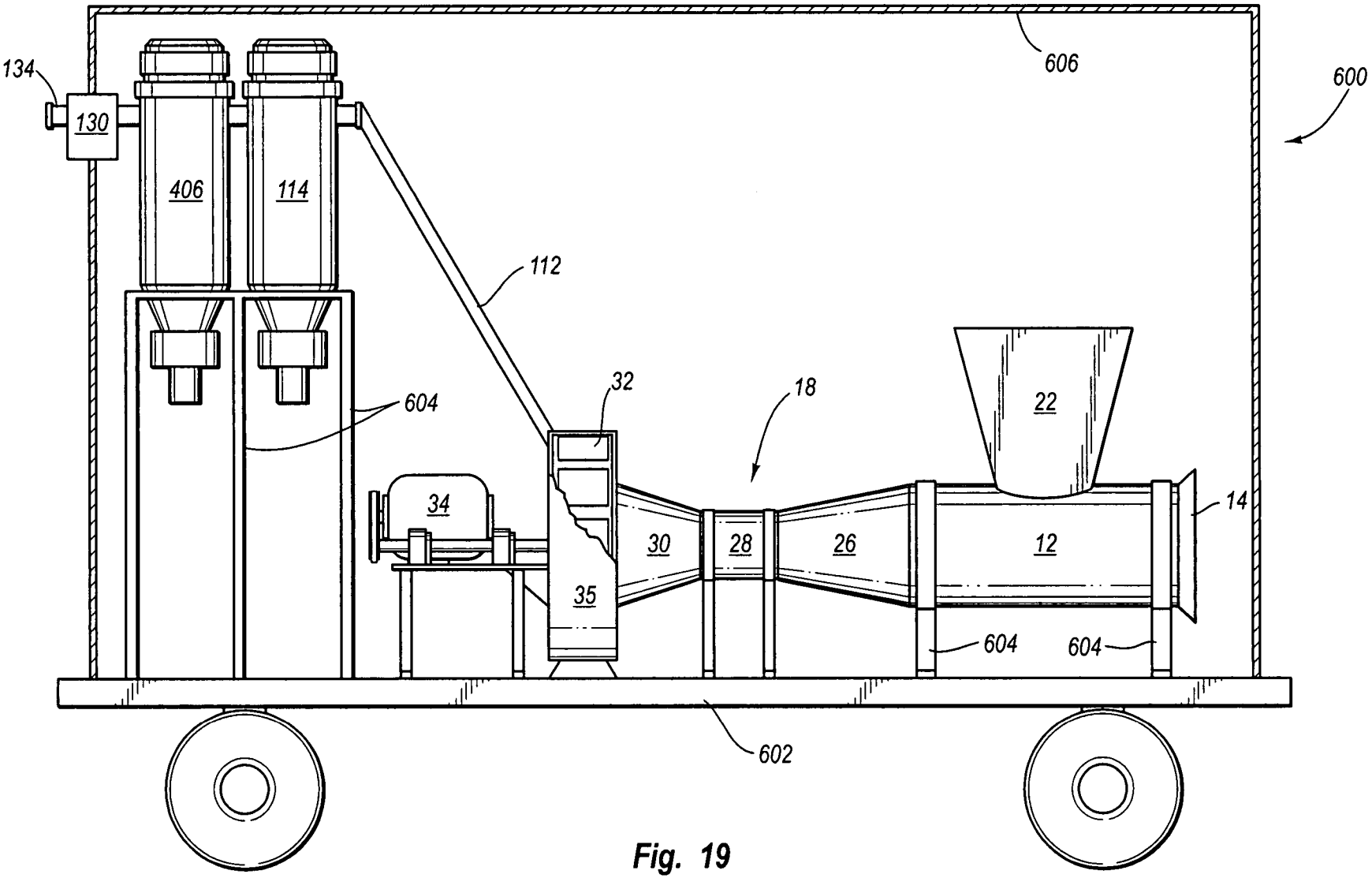
FIG. 19 is a side view of an alternative embodiment of a pulverizing system of the present invention.

Referring to a FIG. 19, a block diagram representing a mobile system 600 is shown. The system 600 includes components previously discussed such as the inlet tube 12, venturi 18, airflow generator 32, housing 35, motor 34, exhaust pipe 112, and first and second cyclones 116, 406. The system 600 may include additional elements such as the blender 102, central processor 110, condenser 130, and so forth. Systems with a plurality of pulverization stages may be mounted on a vehicle in similar manner. Thus, the illustrated system 600 should be considered for exemplary purposes only.

The system 600 includes a vehicle generically represented as 602 and providing a sufficient footprint to support the assembled components. The system 600 further includes a plurality of supports 604 that couple to the vehicle 602 and support any number of assembled components. The system 600 may further include a housing 606 that encompasses components of the system. The housing 606 protects the components and dampens noise during operation.

One or more components of the system 600 may be removable to facilitate transportation. For example, the first and second cyclones 116, 406 may extend out of the housing 606 and need to be moved during transportation. The cyclones 116, 406 may be removed entirely or partially dissembled prior to transportation. Similarly a blender 102 may be removable for transportation. The necessity of removing components is based on the size of the system 600, vehicle 602, and other design constraints.

The housing 606 may accommodate a control room for a user to operate the system 600. The housing 606 may include windows for viewing the components and access for viewing, operation, repair, and inserting material to be processed. The system 600 may have any number of configurations based on convenience, application, and other design considerations. Thus, the illustrated system 600 should be considered as only being an example, and not deemed limiting of the present invention.

It will be obvious to those having skill in the art that many changes may be made to the details of the above-described embodiments without departing from the underlying principles of the invention. The scope of the present invention should, therefore, be determined only by the following claims.

What is claimed is:

1. A method for pulverizing material and extracting moisture from material, comprising:

providing an airflow generator in communication with a venturi;

the airflow generator generating an airflow through the venturi and towards the airflow generator;

introducing the material into the airflow; and passing the material through the venturi to extract moisture and pulverize the material.

2. The method of claim 1, further comprising passing the pulverized material through an input aperture of the airflow generator.

3. The method of claim 1:

disposing the airflow generator within a housing; and passing the pulverized material through an exhaust pipe coupled to an outlet of the housing.

4. The method of claim 3, further comprising inclining the exhaust pipe at an angle ranging from about 25 degrees to about 90 degrees relative to the longitudinal axis of the venturi.

5. The method of claim 3, further comprising providing a flow control valve in the exhaust pipe.

6. The method of claim 3, further comprising:

passing the pulverized material from the exhaust pipe to a cyclone; and the cyclone separating the pulverized material from air.

7. The method of claim 6, further comprising passing the air from the first cyclone to a second cyclone to remove residual particles from the air.

8. The method of claim 6, further comprising passing the air into a condenser to condense vaporized moisture.

9. The method of claim 1, further comprising blending the material prior to introducing the material into the airflow.

10. The method of claim 9, further comprising blending the material with a drying enhancing agent.

11. The method of claim 1, further comprising introducing the material into a hopper prior to introducing the material into the airflow.

12. The method of claim 1, further comprising heating air upstream of the venturi.

13. The method of claim 1, further comprising monitoring a flow rate of the material upstream of the venturi.

14. The method of claim 1, further comprising:

disposing the airflow generator within a housing;

providing a valve on the diverging portion of the venturi; and the valve adjusting the air volume and air velocity within the housing and the airflow generator.

15. The method of claim 1, wherein introducing the material into the airflow includes, providing an inlet tube coupled to the venturi; and introducing the material into the inlet tube.

16. The method of claim 1, wherein the venturi includes a throat and further comprising introducing a throat resizer into the throat to increase airflow velocity.

17. The method of claim 1, further comprising:

disposing the airflow generator within a housing having an outlet;

introducing a restrictor into the outlet to restrict airflow.

18. The method of claim 1, further comprising:

introducing the pulverized material into the airflow; and passing the pulverized material through the venturi to further extract moisture.

19. The method of claim 1, further comprising:

measuring a moisture content of the pulverized material;

upon determining that the moisture content exceeds a threshold value, introducing the pulverized material into an airflow; and passing the pulverized material through the venturi to further extract moisture.

20. The method of claim 1, further comprising:

measuring a particle size of the pulverized material;

upon determining that the particle size exceeds a threshold value, introducing the pulverized material into an airflow; and passing the pulverized material through the venturi to further pulverize the material.

21. The method of claim 1, further comprising varying the velocity of the airflow to provide a desired particle size of the pulverized material.

22. A method for homogenizing materials, comprising:

providing an airflow generator in communication with a venturi;

the airflow generator generating an airflow through the venturi and towards the airflow generator;

introducing first and second materials into the airflow; and passing the first and second materials through the venturi to pulverize and homogenize the materials.

23. The method of claim 22, further comprising blending the first and second materials prior to introducing the first and second materials into the airflow.

24. The method of claim 23, further comprising blending the first and second materials with a drying enhancing agent.

25. The method of claim 22, further comprising introducing the first and second materials into a hopper prior to introducing the first and second materials into the airflow.

26. The method of claim 22, further comprising directing heat to the airflow.

27. The method of claim 25, further comprising monitoring a flow rate of the first and second materials together into the airflow.

28. The method of claim 22, further comprising pulverizing the first material by passing the first material through a venturi prior to introducing first and second materials into the airflow.

29. The method of claim 22, further comprising passing the homogenized materials through an input aperture of the airflow generator.

30. The method of claim 29, further comprising:

disposing the airflow generator within a housing having an outlet; and passing the homogenized materials through an exhaust pipe coupled to the outlet of the housing.

31. The method of claim 30, further comprising inclining the exhaust pipe at an angle ranging from about 25 degrees to about 90 degrees relative to the longitudinal axis of the venturi.

32. The method of claim 30, further comprising providing a flow control valve in the exhaust pipe.

33. The method of claim 30, further comprising:

passing the homogenized materials from the exhaust pipe to a cyclone; and the cyclone separating the homogenized materials from air.

34. The method of claim 33, further comprising passing the air from the first cyclone to a second cyclone to remove residual particles from the air.

35. The method of claim 22, further comprising:

disposing the airflow generator within a housing;

providing a valve on a diverging portion of the venturi; and the valve adjusting the air volume and air velocity within the housing and the airflow generator.

36. The method of claim 22, wherein introducing the first and second materials into the airflow includes, providing an inlet tube coupled to the venturi such that the airflow passes through the inlet tube, and introducing the first and second materials into the inlet tube.

37. The method of claim 22, wherein the venturi includes a throat and further comprising introducing a throat resizer into the throat to increase air velocity.

38. The method of claim 22, further comprising:

disposing the airflow generator within a housing having an outlet; and introducing a restrictor into the outlet to restrict airflow.

39. The method of claim 22, further comprising:

introducing the homogenized materials into the airflow; and passing the homogenized materials through the venturi to further homogenize the first and second materials.

40. The method of claim 22, further comprising:

measuring a moisture content of the homogenized materials;

upon determining that the moisture content exceeds a threshold value, introducing the homogenized materials into an airflow; and passing the homogenized materials through a venturi to further extract moisture within the homogenized materials.

41. The method of claim 22, further comprising:

measuring a particle size of the homogenized materials;

upon determining that the particle size exceeds a threshold value, introducing the homogenized materials into an airflow; and passing the homogenized materials through a venturi to further pulverize the homogenized materials.

42. The method of claim 22, further comprising varying the velocity of the airflow to provide a desired particle size of the pulverized materials.

43. An apparatus for pulverizing material and extracting moisture from material, comprising:

an inlet tube;

a venturi coupled to the inlet tube; and an airflow generator to generate an airflow, the airflow generator in communication with the venturi to direct an airflow through the inlet tube, through the venturi, and toward the airflow generator, wherein material introduced into the airflow passes through the venturi and is subject to pulverization and moisture extraction.

44. The apparatus of claim 43, further comprising a hopper in communication with the inlet tube to receive material and convey material to the inlet tube.

45. The apparatus of claim 44, further comprising a heat generator in communication with the inlet tube.

46. The apparatus of claim 43, further comprising a sensor to monitor the material flow volume to the inlet tube.

47. The apparatus of claim 43, further comprising:

a housing that at least partially encompasses the airflow generator, the housing having an outlet; and an exhaust pipe, coupled to the outlet.

48. The apparatus of claim 47, wherein the exhaust pipe is inclined at an angle ranging from about 25 degrees to about 90 degrees relative to the longitudinal axis of the venturi.

49. The apparatus of claim 47, further comprising a flow control valve in the exhaust pipe.

50. The apparatus of claim 47, further comprising a restrictor disposed within the outlet to limit airflow.

51. The apparatus of claim 47, further comprising a cyclone coupled to the exhaust pipe to separate air from pulverized material.

52. The apparatus of claim 51, further comprising a second cyclone in communication with the first cyclone to receive air and separate residual particles.

53. The apparatus of claim 51, further comprising a condenser in communication with the cyclone to receive air and condense moisture.

54. The apparatus of claim 43, further comprising a blender to blend material to be introduced into the inlet tube.

55. The apparatus of claim 54, further comprising a conveyance device to convey blended material from the blender to the inlet tube.

56. The apparatus of claim 43, further comprising:

a housing at least partially encompassing the airflow generator; and a valve disposed on the diverging portion of the venturi to adjust the air volume and air velocity within the housing and the airflow generator.

57. The apparatus of claim 43, wherein the venturi includes, a converging portion, a throat coupled to the converging portion, and a diverging portion coupled to the throat, and wherein the apparatus further comprises a throat resizer disposed within the throat to increase air velocity.

58. The apparatus of claim 43, wherein the inlet tube has a first end configured as a flange.

59. The apparatus of claim 43, further comprising a mobile vehicle supporting the inlet tube, venturi, and airflow generator.

60. An apparatus for pulverizing material and extracting moisture from material, comprising:

an inlet tube;

a venturi coupled to the inlet tube, wherein the venturi includes, a converging portion, a throat coupled to the converging portion, and a diverging portion coupled to the throat;

an airflow generator to generate an airflow and including an input aperture;

a housing at least partially encompassing the airflow generator and including an outlet in communication with the input aperture, the airflow generator in communication with the venturi to direct the airflow through the venturi, and toward the input aperture, wherein material introduced into the airflow passes through the venturi and is subject to pulverization and moisture extraction;

an exhaust pipe coupled to the outlet; and a cyclone coupled to the exhaust pipe to separate air from pulverized material.

61. The apparatus of claim 60, further comprising a blender to blend material to be introduced into the inlet tube.

62. The apparatus of claim 60, further comprising a conveyance device to convey bended material from a blender to the inlet tube.

63. The apparatus of claim 60, further comprising a throat resizer disposed within the throat to increase air velocity.

64. The apparatus of claim 60, further comprising a hopper in communication with the inlet tube to receive material and convey material to the inlet tube.

65. The apparatus of claim 64, further comprising a heat generator in communication with the hopper.

66. The apparatus of claim 60, further comprising a sensor to monitor the material flow volume to the inlet tube.

67. The apparatus of claim 60, wherein the exhaust pipe is inclined at an angle from about 25 degrees to about 90 degrees relative to the longitudinal axis of the venturi.

68. The apparatus of claim 60, further comprising a flow control valve in the exhaust pipe.

69. The apparatus of claim 60, further comprising a restrictor disposed within the outlet to limit airflow.

70. The apparatus of claim 60, further comprising a second cyclone in communication with the first cyclone to receive air and separate residual particles.

71. The apparatus of claim 60, further comprising a condenser in communication with the cyclone to receive air and condense extracted moisture.

72. The apparatus of claim 60, further comprising a valve disposed on the diverging portion of the venturi to adjust the air volume and air velocity within the housing and the airflow generator.

73. The apparatus of claim 60, wherein the inlet tube has a first end in communication with free space, the first end configured as a flange.

74. The apparatus of claim 60, further comprising a mobile vehicle supporting the inlet tube, venturi, airflow generator, housing, exhaust pipe, and cyclone.

75. The apparatus of claim 60 wherein the housing further includes a diverter plate coupled to the interior of the housing proximate to the outlet and having a cutting edge proximate to the airflow generator.

76. The apparatus of claim 60 wherein an interior diameter of the inlet tube has approximately a two to one ratio with the interior diameter of the throat.

77. An apparatus for pulverizing material and extracting moisture from material, comprising:

a first inlet tube;

a first venturi coupled to the first inlet tube;

a first airflow generator to generate an airflow and including a first input aperture;

a first housing having a first outlet in communication with the first input aperture, the first airflow generator in communication with the first venturi to direct an airflow through the first venturi, and toward the first input aperture, wherein material introduced into an airflow passes through the first venturi and is subject to pulverization and moisture extraction;

a first exhaust pipe coupled to the first outlet;

a first cyclone coupled to the first exhaust pipe to separate air from pulverized material;

a second inlet tube to receive pulverized material from the first cyclone;

a second venturi coupled to the second inlet tube;

a second airflow generator to generate an airflow and including a second input aperture, a second housing including a second outlet in communication with the second input aperture, the second airflow generator in communication with the second venturi to direct an airflow through the second venturi, and toward the second input aperture, wherein pulverized material introduced into an airflow passes through the second venturi and is subject to further pulverization and moisture extraction;

a second exhaust pipe coupled to the second outlet; and a second cyclone coupled to the second exhaust pipe to separate air from pulverized material.

78. The apparatus of claim 77, further comprising a blender to blend material to be introduced into the first inlet tube.

79. The apparatus of claim 78, further comprising a conveyance device to convey blended material from the blender to the first inlet tube.

80. The apparatus of claim 77, further comprising:

a first hopper in communication with the first inlet tube to receive material and convey material to the first inlet tube; and a second hopper in communication with the second inlet tube to receive pulverized material and convey pulverized material to the second inlet tube.

81. The apparatus of claim 80, further comprising a heat generator in communication with the first and second hoppers.

82. The apparatus of claim 77, further comprising a sensor to monitor the material flow rate to the first inlet tube.

83. The apparatus of claim 77, wherein the first and second exhaust pipes are inclined at an angle from about 25 degrees to about 90 degrees relative to the longitudinal axis of the corresponding first and second venturis.

84. The apparatus of claim 77, further comprising:

a first flow control valve disposed in the first exhaust pipe; and a second flow control valve disposed in the second exhaust pipe.

85. The apparatus of claim 77, further comprising:

a third cyclone in communication with the first cyclone to receive air and separate residual particles; and a fourth cyclone in communication with the second cyclone to receive air and separate residual particles.

86. The apparatus of claim 77, further comprising:

a first condenser in communication with the first cyclone to receive air and condense vaporized moisture; and a second condenser in communication with the second cyclone to receive air and condense vaporized moisture.

87. The apparatus of claim 77, further comprising:

a first valve disposed on the first venturi to adjust air volume and air velocity within the first housing and the first airflow generator; and a second valve disposed on the second venturi to adjust air volume and air velocity within the second housing and the second airflow generator.

88. An apparatus for pulverizing material and extracting moisture from material, comprising:

a first inlet tube;

a first venturi coupled to the first inlet tube;

a first airflow generator to generate an airflow and including a first input aperture;

a first housing at least partially encompassing the first airflow generator and having a first outlet in communication with the first input aperture, the first airflow generator in communication with the first venturi to direct an airflow through the first venturi, and toward the first input aperture, wherein material introduced into an airflow passes through the first venturi and is subject to pulverization and moisture extraction;

a first exhaust pipe coupled to the first outlet;

a first cyclone coupled to the first exhaust pipe to separate air from pulverized material;

a second inlet tube to receive pulverized material from the first cyclone;

a second venturi coupled to the second inlet tube;

a second airflow generator to generate an airflow and including a second input aperture, a second housing at least partially encompassing the second airflow generator and including a second outlet in communication with the second input aperture, the second airflow generator in communication with the second venturi to direct an airflow through the second venturi, and toward the second input aperture, wherein pulverized material introduced into an airflow passes through the second venturi and is subject to further pulverization and moisture extraction;

a second exhaust pipe coupled to the second outlet;

a second cyclone coupled to the second exhaust pipe to separate air from pulverized material;

a third inlet tube to receive pulverized material from the second cyclone;

a third venturi coupled to the third inlet tube;

a third airflow generator to generate an airflow and including a third input aperture;

a third housing at least partially encompassing the third airflow generator and including a third outlet in communication with the third input aperture, the third airflow generator in communication with the third venturi to direct an airflow through the third venturi, and toward the third input aperture, wherein pulverized material introduced into an airflow passes through the third venturi and is subject to further pulverization and moisture extraction;

a third exhaust pipe coupled to the third outlet; and a third cyclone coupled to the third exhaust pipe to separate air from pulverized material.

89. The apparatus of claim 88, further comprising a blender to blend material to be introduced into the first inlet tube.

90. The apparatus of claim 89, further comprising a conveyance device to convey blended material from the blender to the first inlet tube.

91. The apparatus of claim 88, further comprising:

a first hopper in communication with the first inlet tube to receive material and convey material to the first inlet tube;

a second hopper in communication with the second inlet tube to receive pulverized material and convey pulverized material to the second inlet tube; and a third hopper in communication with the third inlet tube to receive pulverized material and convey pulverized material to the third inlet tube.

92. The apparatus of claim 88, further comprising:

a third cyclone in communication with the first cyclone to receive air and separate residual particles;

a fourth cyclone in communication with the second cyclone to receive air and separate residual particles; and a fifth cyclone in communication with the third cyclone to receive air and separate residual particles.

93. The apparatus of claim 88, further comprising:

a first condenser in communication with the first cyclone to receive air and condense vaporized moisture;

a second condenser in communication with the second cyclone to receive air and condense vaporized moisture; and a third condenser in communication with the third cyclone to receive air and condense vaporized moisture.

94. The apparatus of claim 88, further comprising:

a first valve disposed on the first venturi to adjust air volume and air velocity within the first housing and the first airflow generator;

a second valve disposed on the second venturi to adjust air volume and air velocity within the second housing and the second airflow generator; and a third valve disposed on the third venturi to adjust air volume and air velocity within the third housing and the third airflow generator.

95. An apparatus for pulverizing material and extracting moisture from material, comprising:

an inlet tube;

a venturi coupled to the inlet tube;

an airflow generator to generate an airflow and including an input aperture;

a housing at least partially encompassing the airflow generator and including an outlet in communication with the input aperture;

the airflow generator in communication with the venturi to direct the airflow through the venturi, and toward the input aperture, wherein material introduced into the airflow passes through the venturi and is subject to pulverization and moisture extraction;

an exhaust pipe coupled to the outlet;

a cyclone coupled to the exhaust pipe to separate air from pulverized material;

a diverter valve coupled to the cyclone and including a first diverter outlet and a second diverter outlet, the diverter valve alternatively directing pulverized material to the first and second diverter outlets; and a recycling tube coupled to the second diverter outlet and in communication with the inlet tube to allow introduction of the pulverized material into the inlet tube and venturi.

96. The apparatus of claim 95, further comprising a blender to blend material to be introduced into the inlet tube.

97. The apparatus of claim 96, further comprising a conveyance device to convey blended material from the blender to the inlet tube.

98. The apparatus of claim 95, further comprising a throat resizer disposed within the throat to increase air velocity.

99. The apparatus of claim 95, further comprising a hopper in communication with the inlet tube to receive material and convey material to the inlet tube.

100. The apparatus of claim 95, further comprising a heat generator in communication with the hopper.

101. The apparatus of claim 95, further comprising a sensor to monitor the material flow volume to the inlet tube.

102. The apparatus of claim 95, wherein the exhaust pipe is inclined at an angle from about 25 degrees to about 90 degrees relative to the longitudinal axis of the venturi.

103. The apparatus of claim 95, further comprising a flow control valve in the exhaust pipe.

104. The apparatus of claim 95, further comprising a restrictor disposed within the outlet to limit airflow.

105. The apparatus of claim 95, further comprising a second cyclone in communication with the first cyclone to receive air and separate residual particles.

106. The apparatus of claim 95, further comprising a condenser in communication with the cyclone to receive air and condense extracted moisture.

107. The apparatus of claim 95, further comprising a valve disposed on the diverging portion of the venturi to adjust the air volume and air velocity within the housing and the airflow generator.

108. The apparatus of claim 95, further comprising a collector coupled to the first diverter outlet.

109. The apparatus of claim 95, further comprising a mobile vehicle supporting the inlet tube, venturi, airflow generator, housing, exhaust pipe, cyclone, diverter valve and recycling tube.

110. The apparatus of claim 95, wherein the housing further comprises a diverter plate coupled to the interior of the housing proximate to the outlet and including a cutting edge proximate to the airflow generator.

* * * * *

UNITED STATES PATENT AND TRADEMARK OFFICE

CERTIFICATE OF CORRECTION

PATENT NO. : 7,059,550 B2 
APPLICATION NO. : 10/706240
DATED : June 13, 2006
INVENTOR(S) : William Graham et al.

It is certified that error appears in the above-identified patent and that said Letters Patent is hereby corrected as shown below:

Column 1, line 66, ". . . is a plan view illustrating a plan view of the . . ." change to -- is a plan view illustrating the--

Column 3, line 39, ". . . to an axel 33 using known methods. The axel 33 . . ." change to --to an axle 33 using known methods. The axle 33--

Column 4, line 49, ". . . the granulization of the material." change to --the granulation of the material.--

Column 5, line 26, ". . . to 72" (1830 mm) . . ." change to --to 72" (1830 mm) --

Column 6, line 14, ". . . of 20 um in one . . ." change to --of 20 µm in one--

Column 6, line 32, ". . . *colifrom, faecal* . . ." change to --*coliform, fecal*--

Column 11, line 56, ". . . may direct pulverize . . ." change to --may direct pulverized--

Column 12, lines 6-7, ". . . and heat effected areas due to heat effected zones." change to --and heat-effected areas due to heat-effected zones.--

Column 12, line 28, ". . . disposed axel aperture . . ." change to --disposed axle aperture--

Column 12, line 29, ". . . the axel aperture . . ." change to --the axle aperture--

Column 12, line 30, ". . . engages an axel or spindle . . ." change to --engages an axle or spindle--

Column 12, line 38, ". . . axel bolt (not shown) that are each coupled to an axel." change to --axle bolt (not shown) that are each coupled to an axle.--

Column 12, line 39, ". . . axel bolts are secured to . . ." change to --axle bolts are secured to--

Column 12, line 61, ". . . view of the axel aperture, . . ." change to --view of the axle aperture--

Column 12, line 62, ". . .The axel aperture . . ." change to --The axle aperture--

Column 12, line 63, ". . . axel, shaft, spindle, . . ." change to --axle, shaft, spindle.--

UNITED STATES PATENT AND TRADEMARK OFFICE

CERTIFICATE OF CORRECTION

PATENT NO. : 7,059,550 B2
APPLICATION NO. : 10/706240
DATED : June 13, 2006
INVENTOR(S) : William Graham et al.

It is certified that error appears in the above-identified patent and that said Letters Patent is hereby corrected as shown below:

Column 12, line 64, ". . . receive an axel bolt . . ." change to --receive an axle bolt--

Column 12, line 66, ". . . axel transitions from a first diameter, with axel bolts . . ." change to --axle transitions from a first diameter, with axle bolts--

Column 12, line 67, ". . . insertion into the axel . . ." change to --insertion into the axle--

Column 13, line 2, ". . . well 513 to receive a nut that engages an axel bolt." change to --well 515 to receive a nut that engages an axle bolt.--

Column 13, line 10, ". . . adjacent the axel aperture . . ." change to --adjacent the axle aperture--

Column 15, line 41, ". . . second cyclones 116, 406." change to --second cyclones 114, 406.--

Column 15, line 58, ". . . second cyclones 116, 406 may . . ." change to --second cyclones 114, 406 may--

Column 15, line 60, ". . . cyclones 116, 406 may be . . ." change to --cyclones 114, 406 may be--

Column 20, line 2, ". . . convey bended material . . ." change to --convey blended material--

Signed and Sealed this

Thirtieth Day of January, 2007

JON W. DUDAS
*Director of the United States Patent and Trademark Office*